US005156347A

United States Patent [19]

Gay, II et al.

[11] Patent Number: 5,156,347

[45] Date of Patent: Oct. 20, 1992

[54] AUTOMATIC CONTINUOUS FIBER WINDER

[76] Inventors: Francis V. Gay, II, 776 Palmetto St., Spartanburg, S.C. 29302; Benjamin A. Gay, R.R. 1, Box 167N, Tryon, N.C. 28782; Philip A. Knight, 121 Riverway Dr., Greer, S.C. 29651

[21] Appl. No.: 626,520

[22] Filed: Dec. 12, 1990

Related U.S. Application Data

[63] Continuation-in-part of Ser. No. 447,672, Dec. 8, 1989, abandoned, which is a continuation-in-part of Ser. No. 175,207, Mar. 30, 1988, Pat. No. 4,893,761.

[51] Int. Cl.[5] ..... B65H 67/048

[52] U.S. Cl. ..... 242/18 A; 242/18 G

[58] Field of Search ..... 242/18 A, 25 A, 18 G

[56] References Cited

U.S. PATENT DOCUMENTS

| | | | |
|---|---|---|---|
| 1,907,896 | 3/1929 | Summey . | |
| 2,335,602 | 6/1938 | Nash et al. . | |
| 3,085,763 | 6/1961 | Floyd, Jr. . | |
| 3,128,958 | 4/1964 | Bongiovanni et al. . | |
| 3,408,012 | 10/1968 | Smith et al. . | |
| 3,471,278 | 10/1969 | Griem, Jr. . | |
| 3,489,363 | 1/1970 | Diolot . | |
| 3,494,753 | 2/1970 | Sears . | |
| 3,512,725 | 5/1970 | Smith et al. . | |
| 3,556,755 | 1/1971 | Dent, Jr. . | |
| 3,614,007 | 10/1971 | Leonark . | |
| 3,637,156 | 1/1972 | Shepherd . | |
| 3,652,243 | 3/1972 | Jensen et al. . | |
| 3,722,808 | 3/1972 | Brown . | |
| 3,813,051 | 5/1974 | Miller . | |
| 3,977,616 | 8/1976 | Owens et al. . | |
| 4,036,446 | 7/1977 | Schar . | |
| 4,146,376 | 3/1979 | Beckman et al. . | |
| 4,230,284 | 10/1980 | Cunningham et al. . | |
| 4,232,835 | 11/1980 | Benin . | |
| 4,298,171 | 11/1981 | Fluckiger et al. | 242/18 A |
| 4,349,365 | 9/1982 | Matteson et al. . | |
| 4,440,557 | 4/1984 | Morrison et al. . | |
| 4,458,850 | 7/1984 | Sugioka et al. . | |
| 4,552,313 | 11/1985 | Sasaki | 242/18 A |
| 4,566,642 | 1/1986 | Sommer et al. . | |
| 4,575,015 | 3/1986 | Sugioka et al. . | |
| 4,598,876 | 7/1986 | Schefer . | |
| 4,613,090 | 9/1986 | Sugioka . | |
| 4,676,441 | 6/1987 | Maag . | |
| 4,709,866 | 10/1987 | Schefer . | |
| 4,715,548 | 12/1987 | Miyake et al. . | |
| 4,811,910 | 3/1989 | Busenhart et al. . | |
| 4,828,191 | 5/1989 | Ruge et al. . | |
| 4,893,761 | 1/1990 | Gay . | |
| 4,917,319 | 4/1990 | Lenk . | |

FOREIGN PATENT DOCUMENTS

| | | | |
|---|---|---|---|
| 2118147 | 10/1972 | Fed. Rep. of Germany | 242/18 A |
| 15369 | 1/1985 | Japan | 242/18 A |
| 873891 | 8/1961 | United Kingdom . | |

*Primary Examiner*—Stanley N. Gilreath
*Attorney, Agent, or Firm*—Foley & Lardner

[57] ABSTRACT

An improved glass fiber winding apparatus including a pair of winding collets rotatably supported by a turret and separated by a movable winding shield. The collets are controllably rotated by the turret between a winding position and an unloading position. At the winding position, one collet is active for purposes of winding glass fibers, while the collet at the unloading position is inactive and the fibers wound upon that collet may be removed such that the collet is freed for future winding. The winding shield is interposed between the two collets so that debris, such as lubricants, are prevented from contaminating the inactive collet. The winding shield is configured such that it can be moved to avoid interference with the fibers during the process of moving a fully wound collet from the winding position to the unloading position. The collet moved from the unloading position is moved upon that collet. When the initiation of fiber winding is complete, fiber winding upon the fully would collet is terminated.

6 Claims, 21 Drawing Sheets

AUTOMATIC CONTINUOUS FIBER WINDER

RELATED APPLICATIONS

This is a continuation-in-part of application Ser. No. 07/447,672 filed on Dec. 8, 1989 for Air Pressure Activated Collet, now abandoned, which is a continuation of application Ser. No. 07/175,207 filed on Mar. 30, 1988, now U.S. Pat. No. 4,893,761 issued on Jan. 16, 1990.

BACKGROUND OF THE INVENTION

This invention relates generally to the production of continuous glass fibers, and more particularly, to the winding of continuous glass fibers onto a cylinder (tube) to form a primary package of fiber.

In general, manufacturing process for producing and winding continuous glass fibers are known. Schematic representations of a typical example of such prior art processes are shown in FIGS. 1A and 1B. Respective continuous glass fibers 1002 are made by the rapid mechanical attenuation of molten glass exuding from a furnace through a bushing 1004 incorporating a large number of nozzles. During the fiber production process an individual fiber (filaments) 1002 exudes from each of the nozzles, to form two fans 1008 of filaments. The respective filaments of fans 1008 pass through a light water spray 1010 (FIG. 1A), over an applicator 1009 which transfers a protecting and lubricating "size" onto the filaments, and are then gathered by a suitably U-shaped shoe into a bundled strand of filaments 1012. Strand 1012 then passes to a winder 1014 which mechanically attenuates the strands 1012 and forms a package (cake) 1020 of continuous strand 1012.

Strands 1012 are wound about a rotating collet 1016 bearing a paper or plastic tube 1018. A predetermined amount of continuous strand 1012 is wound onto tube 1018 to form a cake 1020. A traverse 1019 is typically employed to lay successive lengths of a continuous strand 1012 onto tube 1018 at small angles to one another to facilitate subsequent unwinding of the fiber from the package.

Terminating the winding process to remove cake 1020 from the collet 1016 tends to be problematical. During the time period required to remove the cake 1020 from the collet and place a new tube 1018 on the collet 1016, molten glass continues to exude from each nozzle of bushing 1004. All of such exuded molten glass is wasted and must be removed for disposal before the winding process can be restarted.

To deal with this problem, automatic winders have been implemented with two alternately operable collets for winding continuous strands 1012. After a complete cake is wound on one collet, strand 1012 is transferred to and wound about the second collet, while cake 1020 is removed from the first. Referring to FIGS. 2A-2E, such a prior art automatic winder 1022 includes two collets 1028 and 1030, and a winding shield 1026, all mounted on a rotatable turret 1024. In operation, strand 1012 is wound about collets 1028 and 1030 on an alternating basis; turret 1024 is rotated to dispose first one and then the other collet to receive strand 1012. Shield 1026 serves to prevent debris such as water and lubricant (size) from being deposited on the inactive collet.

More particularly, referring to FIG. 2A, one of the collets, e.g., collet 1028, rotatable at a predetermined speed, is disposed to receive strand 1012. Strand 1012 is thus wound onto a tube supported by collet 1028. After a predetermined amount of continuous strand 1012 is wound onto the tube, a transfer of strand 1012 to the other collet leg, collet 1030, is effected. The transfer between collets involves a number of steps:

a mechanism pushes strand 1012 to the front of rotating collet 1028 beyond the lateral extent of shield 1026 to ensure that shield 1026 does not interfere with strand 1012 when turret 1024 is rotated; the inactive collet, e.g., collet 1030 is accelerated to full rotational winding speed; turret 1024 is rotated in a clockwise direction to a predetermined position at which strand 1012 is placed in contact with the feeding (forward) surface of collet 1030 (FIG. 2B); the rotational speed of collet 1028 is reduced, causing loop 1032 to form in strand 1012 between the collets (FIG. 2C); the size of loop 1032 increases until strand 1012 breaks and causes strand 1012 to become completely wrapped around the front end of collet 1030 (FIG. 2D) and begins to wind onto collet 1030; and the cake from collet 1028 is removed while strand 1012 is being wound onto collet 1030 (FIG. 2E).

A significant problem with such prior art is that strand 1012 frequently breaks before a successful transfer is made between collets. Accordingly, human intervention is required to restart the winding process, and, until the process is restarted, exuded molten glass is wasted.

A number of factors contribute to the breakage of strand 1012 during an attempted transfer between collets. A primary factor is the requirement that strand 1012 be forced to the front of the collets to clear shield 1026 during the transfer between collets. Another factor is that a typical automatic winder only has the ability to rotate turret 1024 in one direction between two index positions. This tends to restrict the ability by adjusting and optimizing the angle at which strand 1012 contacts the collets when a transfer is made.

Another problem which arises with many automatic winders is their inability to maintain a relatively constant distance between the traverse 1019 (FIG. 1) and the point at which strand 1012 engages cake 1020 as the diameter of the cake increases during the winding process. This tends to cause the tension in strand 1012 to change as the diameter of the cake increases and, in turn, varies the diameter of strand 1012 in relation to the cake diameter. This problem can also be attributed to limiting rotation of turret 1024 to a single direction and between two fixed index positions.

Thus, there remains the need for an automatic winder which reduces the frequency of strand breakage during the transfer of strands between winder collets, an improved winding shield, and an arrangement for providing selective bi-directional rotation of a turret.

SUMMARY OF THE INVENTION

The invention provides a fiber winding apparatus of the type including a support structure, a turret rotatably supported relative to the support structure, a first collet rotatably supported by the turret, and a second collet rotatably supported by the turret. The apparatus further includes a variable configuration winding shield for inhibiting the transfer of debris between the first collet and the second collet. The winding shield is selectively configurable into a fiber winding configuration and a fiber transfer configuration.

The invention further provides a fiber winding apparatus of the type comprising a support structure, a turret supported relative to the support structure for rotation about a central longitudinal axis, and first and second collets rotatably supported by the turret. The apparatus further includes a means for selectively rotating the turret clockwise and counter-clockwise between a first predetermined angular position and a second predetermined angular position, and means for preventing the turret from rotating when the turret is not being selectively rotated.

The invention further provides a fiber winding apparatus comprising a support structure, a turret supported relative to the support structure such that the turret is permitted to rotate, first and second collets rotatably supported by the turret, means for selectively rotating the turret clockwise and counter-clockwise between a first predetermined position and a second predetermined position, means for selectively preventing the turret from rotating while in the first and second predetermined positions, and a variable configuration winding shield which inhibits the transfer of debris between the first collet and the second collet. The winding shield is selectively configurable into a fiber winding configuration and a fiber transfer configuration.

The invention further provides a fiber winding apparatus including a support structure, a turret rotatably supported relative to the support structure, first and second collets rotatably supported by the turret, and a variable configuration winding shield for inhibiting the transfer of debris between the first collet and the second collet. The winding shield is selectively configurable into a fiber winding configuration and a fiber transfer configuration. One or both of the first and second collets includes a housing assembly mounted to for rotation relative to the turret. The assembly includes a first and second group of segments radially moveable between respective first and second positions. The first and second group of segments provide a cylindrical surface when in the first position. The assembly further includes a moveable means, responsive to an external source of energy, for moving the first group of segments from one of the first and second positions to the other of the positions, and biasing means for biasing the moveable means to maintain the first group of segments in the one of the positions in the absence of the external source of energy. The first and second groups of segments are coupled to each other such that movement of the first group between respective first and second positions causes the second group to move between the respective first and second positions.

The invention still further provides a fiber winding apparatus of the type including a support structure, a turret rotatably supported relative to the support structure, a first collet rotatably supported by the turret, and a second collet rotatably supported by the turret. The apparatus further includes a variable configuration winding shield for inhibiting the transfer of debris between the first collet and the second collet. The winding shield is selectively configurable into a fiber winding arrangement. One or both of the first and second collets include a centrally located shaft, a tubular shaped mandrel disposed about the shaft, hubs mounted for rotary movement about the mandrel, and a housing assembly disposed between the hubs and connected thereto. The housing assembly includes a plurality of fingers and a plurality of wedges, each of the fingers having a curved outer surface disposed for radial movement between first and second positions and means for coupling the housing assembly to the centrally located shaft. Each of the wedges has a curved outer surface disposed for radial movement between first and second positions, the fingers and the wedges when in respective first positions having the respective curved outer surfaces collectively forming a cylindrical surface. The wedges are coupled to the fingers and move between the respective first and second positions in response to movement of the fingers.

The invention further provides a fiber winding apparatus including a support structure, a turret rotatably supported relative to the support structure, first and second collets rotatably supported by the turret, means for selectively rotating the turret in the clockwise and the counter-clockwise directions between a first predetermined position and a second predetermined position, and means for preventing the turret from rotating while in the first and second predetermined positions. One or both of the first and second collets include a housing assembly mounted for rotation relative to the turret. The assembly includes a first and second group of segments radially moveable between respective first and second positions. The first and second group of segments providing a cylindrical surface when in the first position. The assembly also includes a moveable means, responsive to an external source of energy, for moving the first group of segments from one of the first and second positions to the other of the positions, and biasing means for biasing the moveable means to maintain the first group of segments in the one of the positions in the absence of the external source of energy. The first and second groups of segments are coupled to each other such that movement of the first group between respective first and second positions causes the second group to move between the respective first and second positions.

The invention further provides a fiber winding apparatus including a support structure, a turret rotatably supported relative to the support structure, means for selectively rotating the turret in the clockwise and the counter-clockwise directions between a first predetermined position and a second predetermined position, means for preventing the turret from rotating while in the first and second predetermined positions, and means for supporting the collets upon the turret. The first and second collets each include a centrally located shaft, a tubular shaped mandrel disposed about the shaft, hubs mounted for rotary movement about the mandrel, and a housing assembly disposed between the hubs and connected thereto. The housing assembly includes a plurality of fingers and a plurality of wedges. Each of the fingers have a curved outer surface adapted for radial movement between first and second positions and means for coupling the housing assembly to the centrally located shaft. Each of the wedges have a curved outer surface adapted for radial movement between first and second positions, the fingers and the wedges when in respective first positions have the respective curved outer surfaces collectively forming a cylindrical surface. The wedges are coupled to the fingers and move between the respective first and second positions in response to movement of the fingers.

The invention also provides a method for winding at least one length of glass fiber onto a first collet rotatably supported by a rotatable turret, wherein the rotatable turret rotatably supports a second collet and supports a variable configuration winding shield interposed between the collets. The method includes the steps of rotating the turret in a first direction to dispose the first collet in a winding start position for engaging the glass fiber, engaging the fiber with the first collet, accelerating the first collet to a first rotational speed suitable for winding the fiber, and accelerating the second collet to a second rotational speed after a first predetermined number of elapsed rotations of the first collet during winding. The method also includes the steps of changing the configuration of the winding shield to permit rotation of the turret to dispose the second collet in a position to contact the glass fiber, rotating the turret to position the second collet in contact with the glass fiber, increasing the speed differential between the rotational speed of the first and second collets such that the glass fiber wraps around the second collet to break the portion of the glass fiber located between the collets, and changing the configuration of the winding shield to its winding configuration such that the first collet is shielded from the second collet.

The invention further provides a method for winding at least one length of glass fiber onto a first collet rotatably supported by a rotatable turret. The method includes the steps of rotating the turret in a first direction to dispose the first collet in a winding start position for engaging the glass fiber, engaging the fiber with the first collet, accelerating the first collet to a first rotational speed suitable for winding the fiber, decelerating the collet to a second rotational speed after a first predetermined number of elapsed rotations of the first collet to selectively control the tension in the fiber, and rotating the turret after a third predetermined number of elapsed rotations of the first collet.

BRIEF DESCRIPTION OF THE DRAWING

The preferred exemplary embodiment of the present invention will hereinafter be described in conjunction with the appended drawing, wherein like designations denote like elements, and.

DETAILED DESCRIPTION OF THE PREFERRED EXEMPLARY EMBODIMENT

Figure 1A:
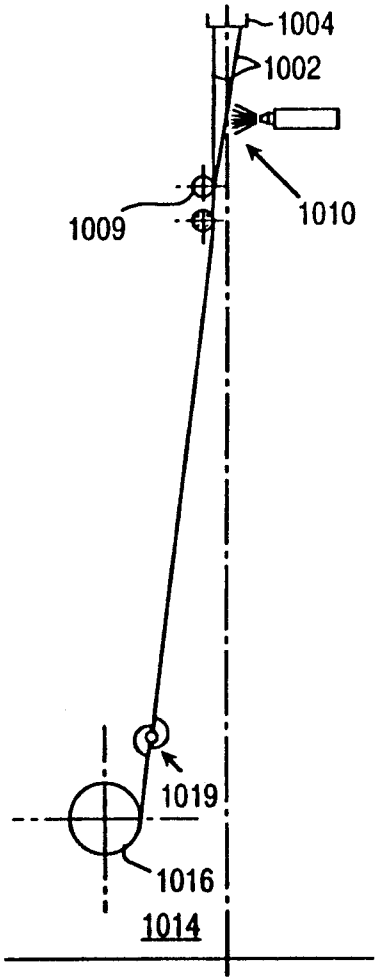
Fig. 1A PRIOR ART
FIGS. 1A and 1B are schematic representations of a typical prior art manufacturing process for producing and winding continuous glass fibers.
Figure 1B:
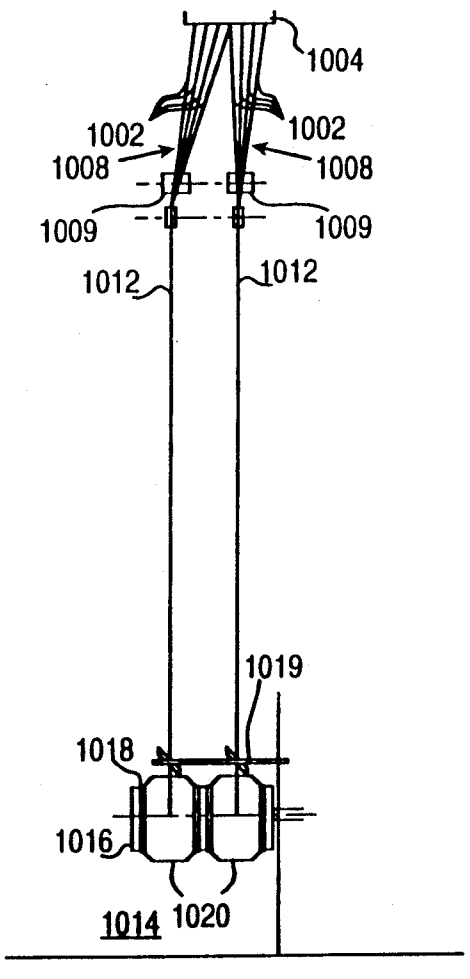
Fig. 1B PRIOR ART
Figures 2A, 2B, 2C, 2D, 2E:
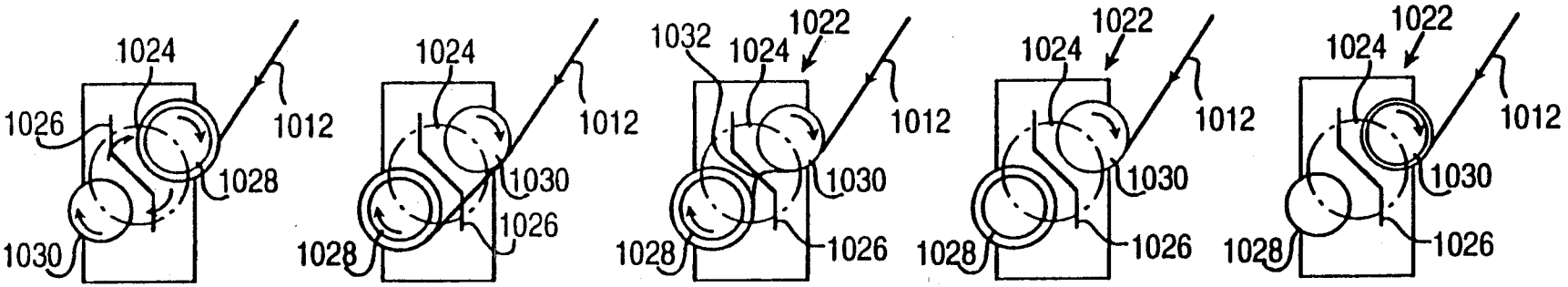
Fig. 2A (PRIOR ART)
Fig. 2B (PRIOR ART)
Fig. 2C (PRIOR ART)
Fig. 2D (PRIOR ART)
Fig. 2E (PRIOR ART)
FIGS. 2A–2E are schematic representations of a prior art fiber winding process.
Figure 3:
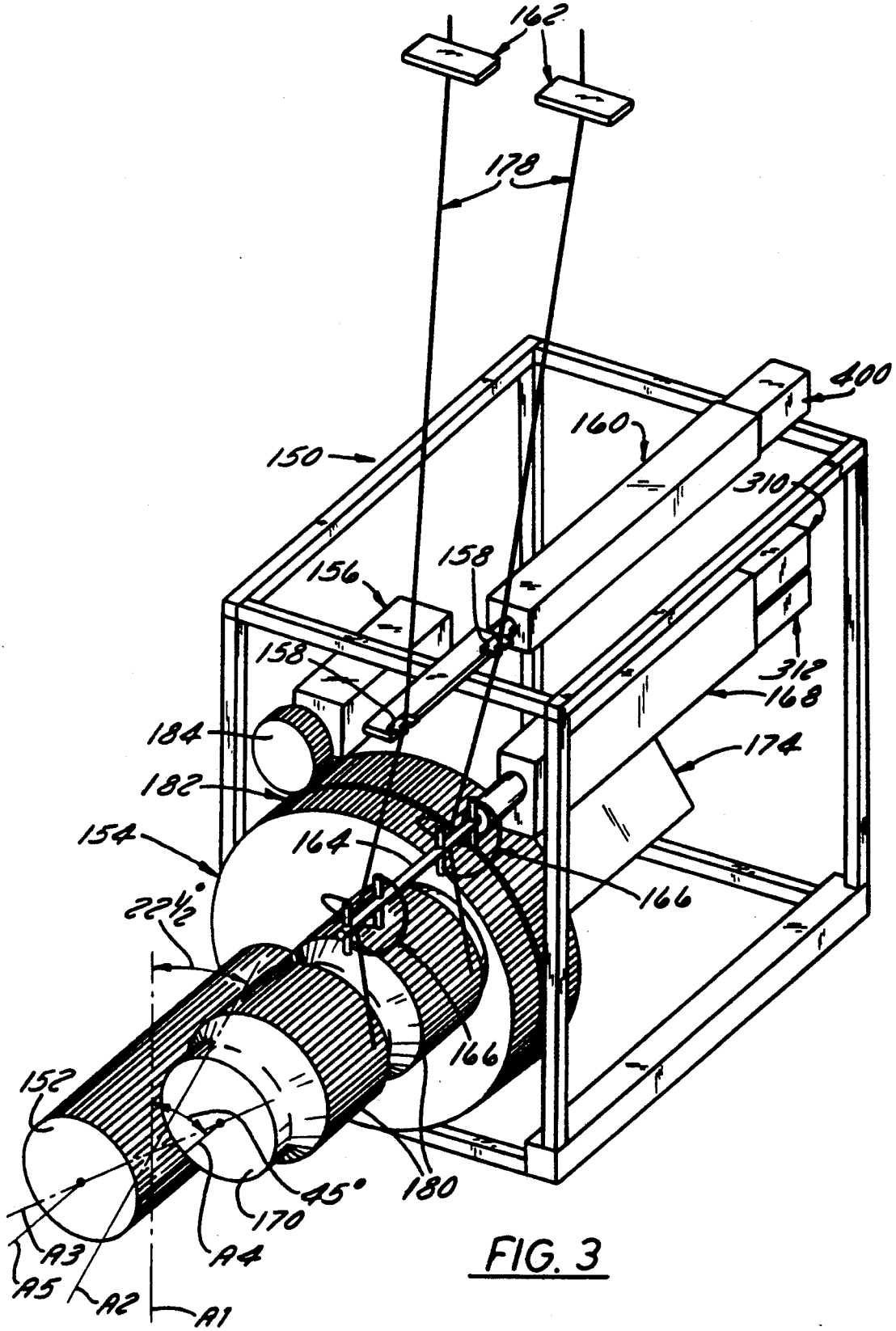
FIG. 3 is a perspective view of the preferred exemplary embodiment of the improved automatic continuous fiber winder.

Referring to FIG. 3, an automatic continuous fiber winder 150 in accordance with the present invention suitably includes: a first collet 152 (inactive in FIG. 3); a second collet 170 (active in FIG. 3); a rotating turret 154; a turret drive motor 156; a pair of lower strand splitters 158; a lower strand splitter oscillating unit 160; a pair of upper strand splitters 162; a traverse 164; a pair of spirals 166 mounted to traverse 164; a traverse rotating and oscillating unit 168; a collet rotation motor 174 for rotating collet 170 (a second collet rotation motor 172 for rotating collet 152 is not shown on FIG. 3); and a support frame 176 for the assembly.

Under certain conditions, the proper operation of a winder 150 requires the provision of a cooling air flow over winder 150. Accordingly, if conditions require, the appropriate duct work and air handling unit (not shown) would be set up to provide a cooling air flow to winder 150.

A pair of strands (fibers) 178 from a fiber bushing (not shown) are routed past strand splitters 162 to lower strand splitters 158 and therefrom through spirals 166 to collet 170, on which a pair of cakes 180 are wound.

Figure 4:
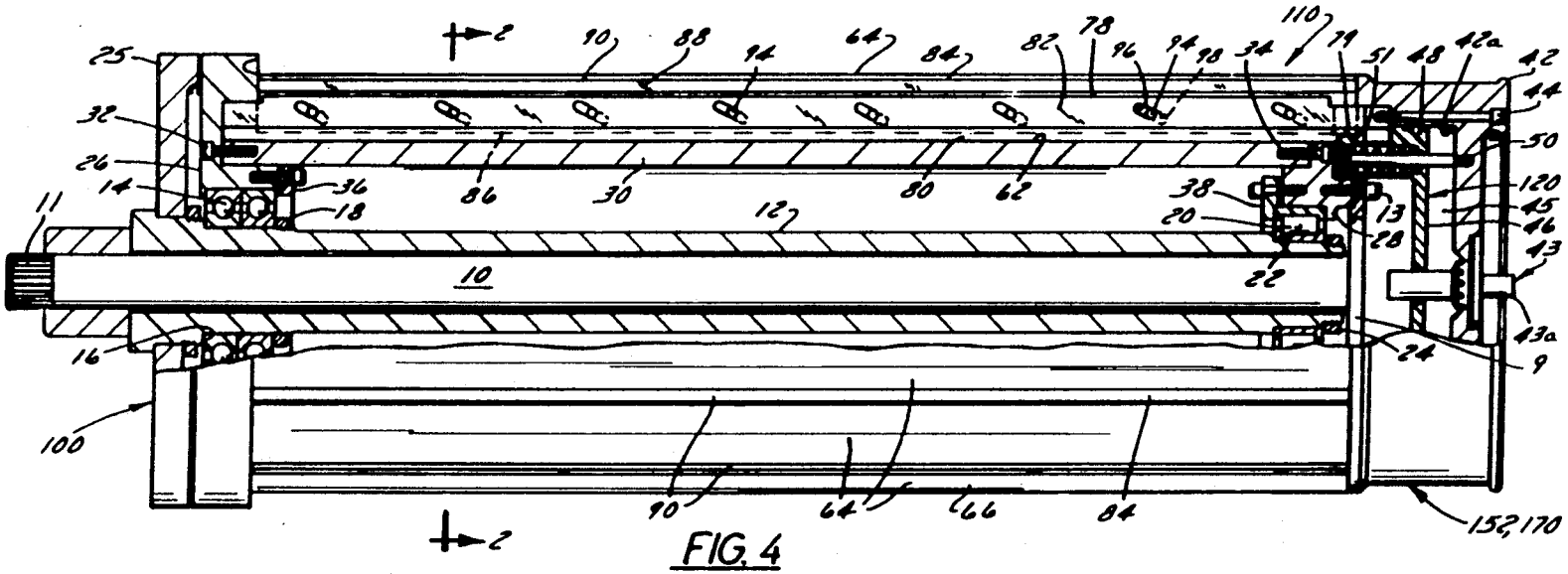
FIG. 4 is a side sectional view of a collet in accordance with the present invention.

Referring now to FIG. 4, collets 152 and 170 preferably comprise: a drive shaft 10; a hub assembly 100 including a rear shield member 25 and a mandrel 12; a housing assembly 110 which forms the operating surface of the collet; and a piston assembly 120. Briefly, drive shaft 10 and associated elements interact with and cause housing assembly 110 to rotate about the axis of drive shaft 10. Hub assembly 100 includes rear shield member 25, mandrel 12, and a pair of bearing assemblies 14 and 20. A plurality of hub members 26 and 28, and associated elements rotate about the axis of drive shaft 10 and are coupled to housing assembly 110 and drive shaft 10. Housing assembly 110 is keyed to rotating hub members 26 and 28 of hub assembly 100 and generally comprises an annular housing member 30, a plurality of fingers 64 and wedges 84 (best illustrated in FIGS. 5 and 6) which form the surface of the collet, and a plurality of guides 78 (best seen in FIGS. 7A–7D) which couple with piston assembly 120. Piston assembly 120 comprises the various elements including a piston 46 which translates air pressure introduced into piston assembly 120 and the evacuation thereof into movement of the various elements of housing assembly 110.

Hub assembly 100 rotatably mounts housing assembly 110 and drive shaft 10 to turret 154; housing assembly 110, driven by drive shaft 10, rotates relative to turret 154. More particularly, rear shield member 25 of hub assembly 100 is suitably mounted to turret 154 by bolts (not shown). Mandrel 12 extends through rear shield 25 (and turret 154 not shown in FIG. 4) perpendicularly of rear shield member 25 (and hence turret 154). Rear and front bearing assemblies 14 and 20 are disposed on mandrel 12. Rear bearing assembly is suitably a duplex bearing assembly 14 secured against a shoulder 16 of mandrel 12 by a locknut 18. Front bearing assembly 20 suitably comprises a cylindrical roller bearing mounted about the front right (in FIG. 4) of mandrel 12 and secured against axial movement between a shoulder 22 on mandrel 12 and a locknut 24. A plurality of annular clamp rings 36 and 38 are clamped respectively to hub members 26 and 28 to ensure against relative axial movement between hub members 26 and 28 and bearing assemblies 14 and 20. Annular housing member 30 of housing assembly 110 is secured to hub member 26 and hub member 28, suitably by a plurality of bolts 32 and 34, respectively.

Thus, housing assembly 110 is rotatably mounted to mandrel 12 through hub member 26 and bearing assembly 14 at one end, and through front hub member 28 and bearing assembly 20 at the other. Rotation of housing assembly 110 is effected through drive shaft 10. Drive shaft 10 extends through, and is rotatably mounted within, mandrel 12. A portion (to the left in FIG. 4) of drive shaft 10 extending externally of mandrel 12 (and turret 154), suitably has splines formed thereon to facilitate coupling to a collet rotation motor (not shown in FIG. 4). The other end of drive shaft 10 (to the right in FIG. 4) is coupled to hub member 28 (and thus to housing assembly 110) through a drive plate 9. Drive plate 9 is fastened to hub member 28 with a plurality of bolts 13. Accordingly, when drive shaft 10 is rotated the rotational motion of drive shaft 10 is transferred to housing assembly 110 via drive plate 9, bolts 13, and hub member 28.

Figure 4A:
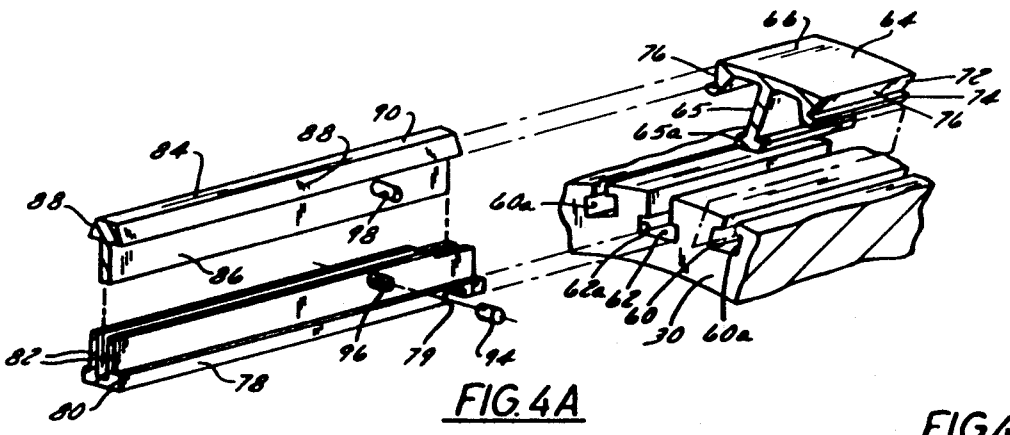
FIG. 4A is an exploded perspective view depicting the spatial relationship of the fingers, wedges and guides of the collet in accordance with the present invention.
Figure 5:
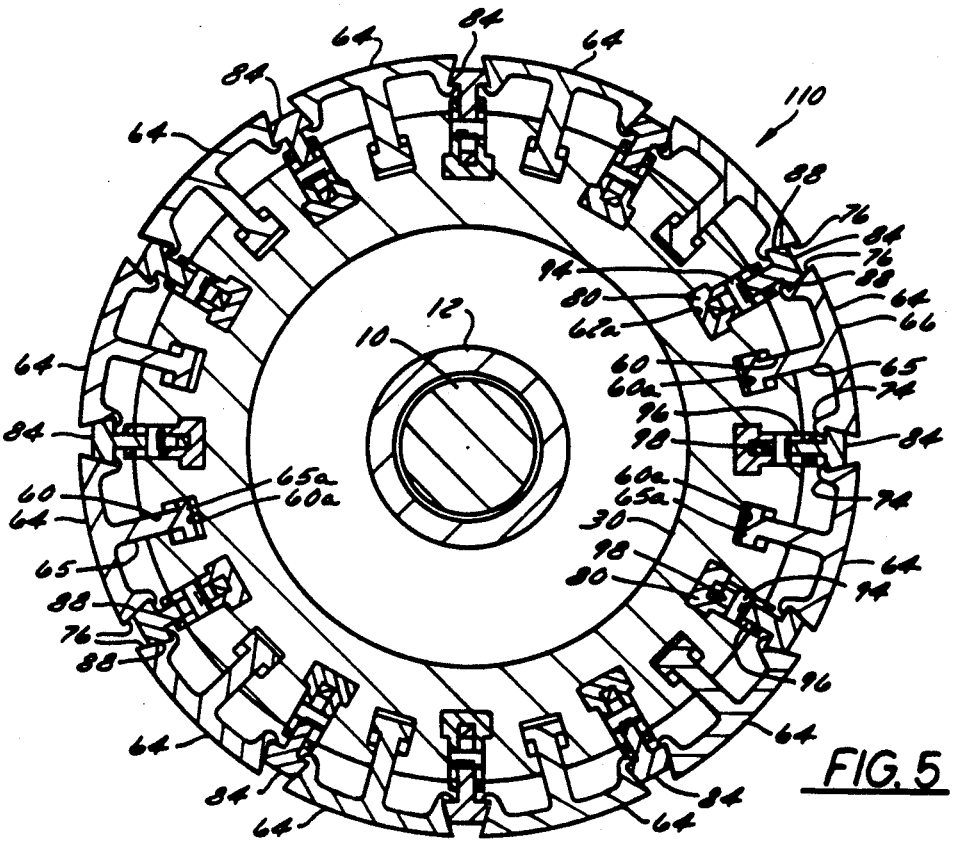
FIG. 5 is an axial sectional view taken along lines 2—2 of FIG. 1 in which the collet configuration is in a compressed configuration.

Housing assembly 110 cooperates with piston assembly 120 to controllably present different collet diameters (e.g., an expanded state, contracted state) to facilitate removal of completed packages from the collet, while at the same time presenting a smooth, continuous cylindrical surface during operation. As previously noted, housing assembly 110 includes annular housing member 30, fingers 64 and wedges 84 (FIG. 4A, 5 and 6) which form the surface of the collet and guides 78 which couple with piston assembly 120. Collets 152 and 170 are normally in an expanded state (FIG. 6) with finger 64 and wedges 84 cooperating to form a substantially smooth, continuous cylindrical surface of a first predetermined diameter generally corresponding to the interior diameter of tube 1018 to secure tube 1018 in position. To facilitate disposition and removal of tube 1018, collets 152 and 170 assume a contracted state, in which wedges 84 retreat and fingers 64 contract to define a cylinder of lesser diameter than the inner diameter of tube 1018 (FIG. 5). The state of collets 152 and 170 are controlled by selective application of air to piston assembly 120.

An end cap 42 is tightly bolted to the right end of annular housing member 30 by a plurality of bolts 44 and is provided with an air valve 43. The cavity formed by end cap 42 serves as a cylinder 45 for piston 46. Piston 46 comprises a piston head 48 having outer periphery which guides along the interior surface of end cap 42. An O-ring 47 (FIGS. 7A–7D) is positioned within a circumferential groove in piston head 48.

Extending axially from piston head 48 is an annular piston shaft wall 49 (FIGS. 7A–7D) provided with a small circumferentially extending rib 51. A plurality of respective axial bores **49*a* with counterbore shoulders 53 are formed in piston shaft wall 49 to receive a plurality of shoulder bolts 50, about which are mounted a plurality of compression springs 52. Compression springs 52 are held between counterbore shoulders 53 and the head of shoulder bolts 50. An O-ring 55 (FIGS. 7A–7D) is positioned around the piston shaft wall 49 to provide an air tight seal. Shoulder bolts 50 extend through the small diameter portion of bores 49*a* to end cap 42. Thus, piston 46, although spring biased towards end cap 42, can move along shoulder bolts 50 when a countering force due to increased air compression within cylinder 45 is experienced by piston head 48**.

Figure 4B:
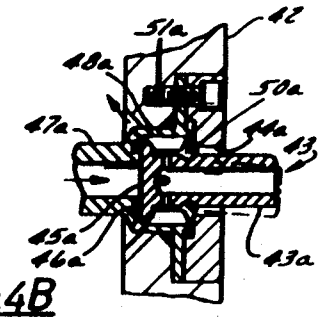
FIG. 4B is a side sectional view of a portion of air cylinder, valve and associated components.

Referring to FIG. 4B, air valve 43 comprises a stem **43*a* mounted within a bore 44*a* and secured to a valve head 45*a*. Valve head 45*a* abuts in an air tight relationship a resilient O-ring 46*a* mounted in and around the mouth of an air channel pipe 47*a* leading to cylinder 45. Air channel pipe 47*a* is provided with an annular flange 48*a* which defines bore 44*a* and is secured to end cap 42 by shoulder bolts 51*a*. A second resilient O-ring 50*a* mounted in flange 48*a* abuts valve head 45*a* on the opposite side thereof. Pressure is introduced into collet air valve 43 through stem 43*a* by use of a flexible hose (not shown) leading from an outside source of compressed air. The technique is identical to the well known process of inflating an automobile tire in that such flexible hoses have a force-opening check valve and a nozzle mating with stem 43*a*. An operator presses a hose connected to a source of compressed air, rocking air valve 43 to one side, as shown by the dotted lines, and compressed air flows into the air valve 43. O-ring 50*a* is then compressed, allowing compressed air to fill cylinder 45, resulting in the collapse of the collet as described in more detail below. When it is desired to evacuate cylinder 45, stem 43*a* is again rocked to the dotted line position, causing valve head 45*a* to compress against O-ring 50*a* and allowing compressed air to exit cylinder 45 as desired. While air valve 43** as shown works satisfactorily, it should be understood that other valve mechanisms compatible with the function of the collet of the present invention could be employed as well.

Figure 6:
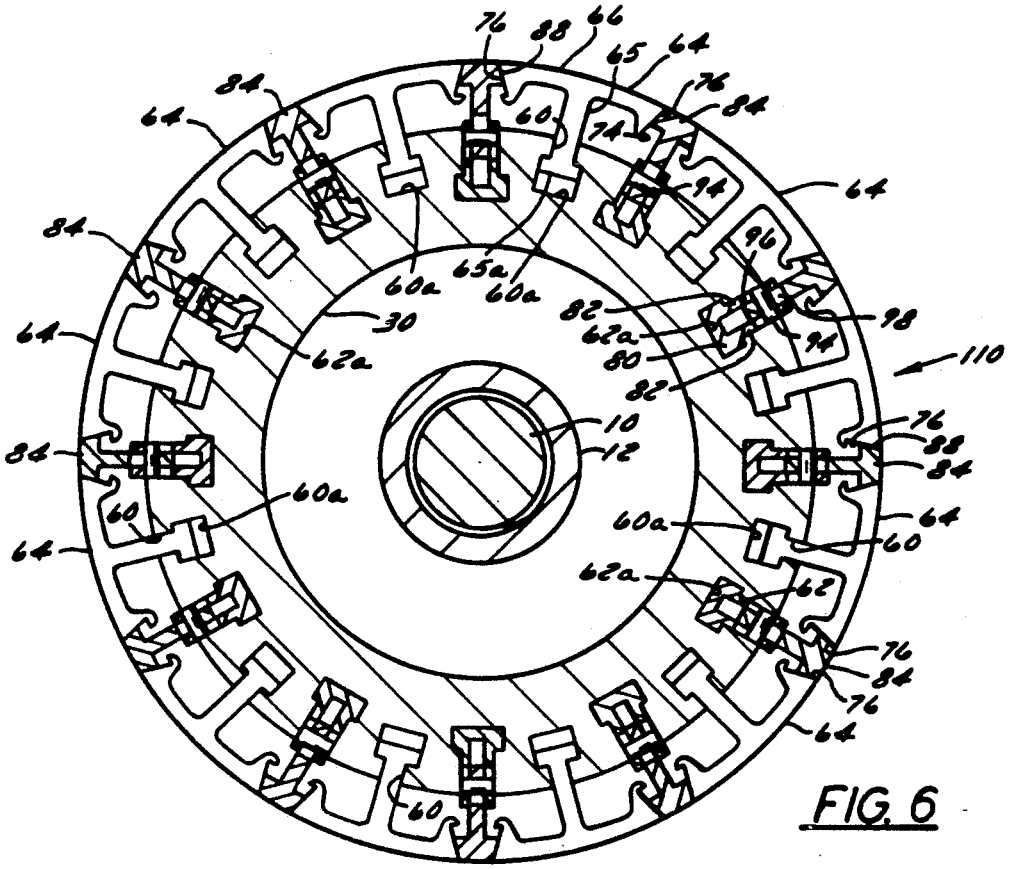
FIG. 6 is an axial sectional view similar to FIG. 2 in which the collet is in an expanded configuration.

As best viewed in FIGS. 4A, 5 and 6, annular housing member 30 is provided with a plurality of channels 60 and 62 aligned parallel to the longitudinal axis of annular housing member 30 and alternately positioned with respect to each other. A finger 64 is positioned within each channel 60. Each finger 64 has a T-shaped cross section with a downward extending stem 65 ending in an enlarged portion (foot) 65*a*. Finger 64 is mounted to slide within its respective channel 60 in a radial direction with respect to the longitudinal axis of annular housing member 30. Channel 60 is provided with an enlarged portion 60*a* geometrically complementary to and enclosing foot 65*a*. Radial movement of finger 64 is permitted between limits by the cooperation between enlarged portion 60*a* and foot 65*a*. Axial movement of finger 64, i.e. movement in the direction of the axis of drive shaft 10, is prevented by the abutment of the ends of fingers 64 with hub member 26 and end cap 42. The top surfaces 66 of fingers 64 are slightly curved toward arms 72 thereof which generally extend in the same direction as stems 65 and terminate at shoulders 74. Each arm 72 further provides a side engaging surface 76 which diverges outwardly from the radial center line of their respective fingers 64.

Wedges 84, together with cooperating axially moveable guides 78, are maintained in channels 62, between each finger 64. Channels 62, like channels 60, have an enlarged bottom portion 62*a*. Guides 78 have a complementary configuration, including an enlarged base 80 and a pair of spaced arms 82. Base 80, by virtue of its tight complimentary fit within enlarged bottom portion 62*a* of channel 62, prevents radial movement of guide 78 but permits axial movement. Each of wedges 84 has a stem 86 positioned between arms 82 of a corresponding guide 78. Axial movement of wedges 84 is restricted due to the abutment of each end thereof against hub member 26 and end cap 42. Each wedge 84 is coupled to its respective guide 78 through the interaction of a roller 94 mounted in a plurality of slots 96 and 98, respectively, formed in the spaced arms 82 of respective guide 78 and slot 98 in the stem 86. Roller 94 rotates fully within slots 96 and 98 and is axially constrained by the abutment of its end thereof against adjacent interior surfaces of annular housing member 30.

Wedges 84 have side surfaces 88 which diverge outwardly from the radial center line thereof and are complementary to and abut finger side engaging surfaces 76. The top or outer surface 90 of wedge 84 is slightly curved toward side surfaces 88 such that, when fingers 64 and wedges 84 move radially outward to the fullest extent possible, the respective top surfaces 66 and 90 form a smooth, continuous cylindrical surface.

Figure 7A:
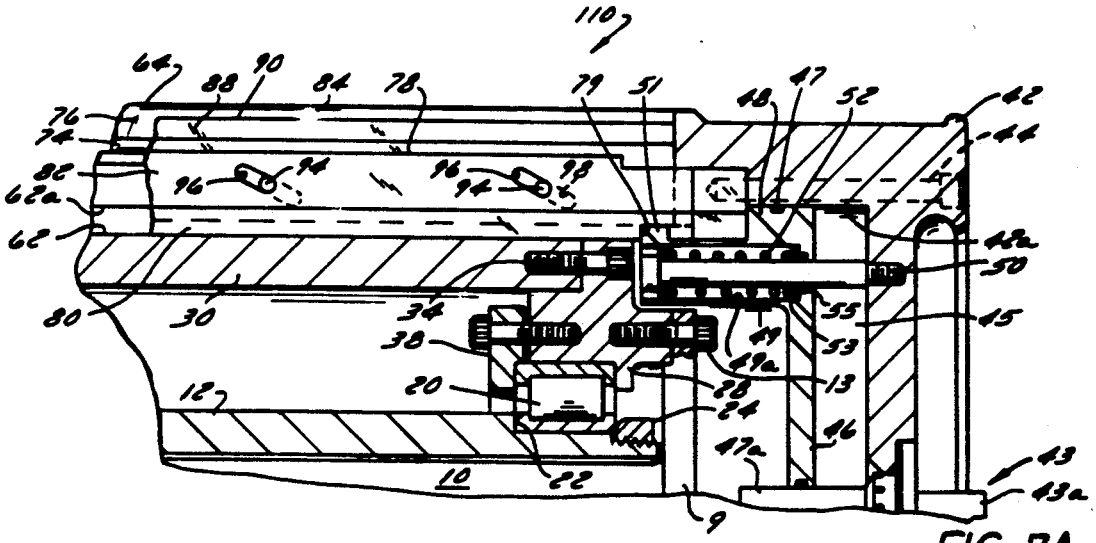
FIGS. 7A–7D are partial sectional views illustrating the coupling relationship between the guide and wedges.
Figure 7B:
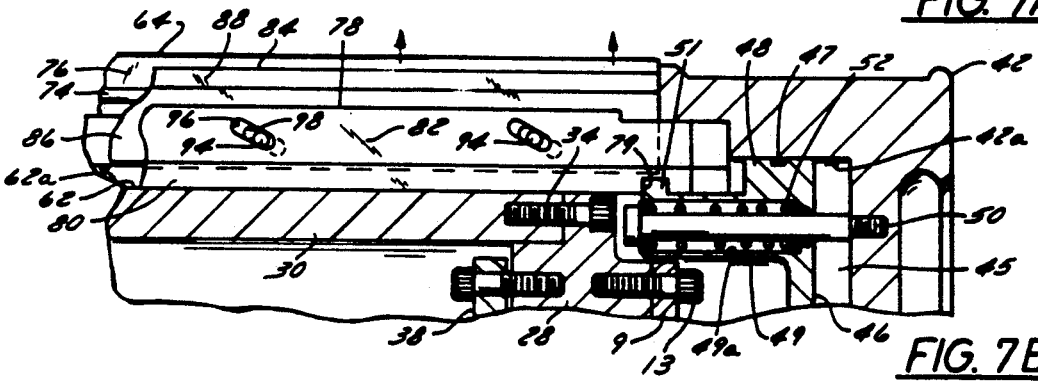
Figure 7C:
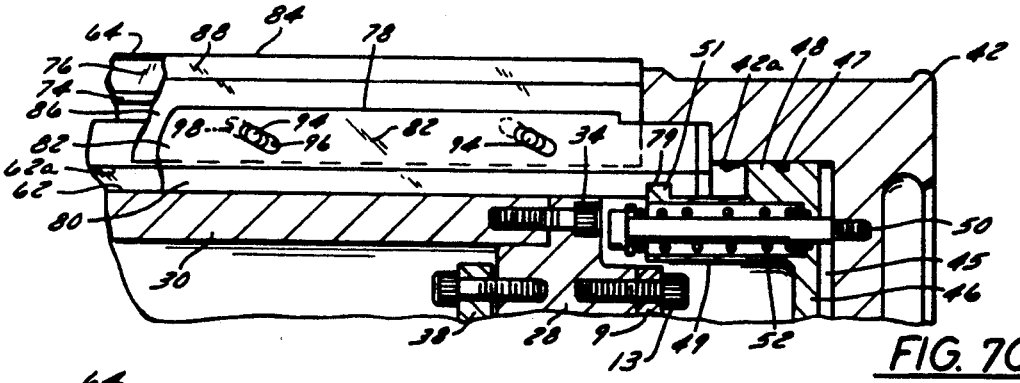

Guide 78 cooperates with piston 46 to controllably effect movement of wedges 84 and fingers 64. Referring to FIG. 7A, each guide 78 includes a notch 79 which fits over rib 51 on piston shaft wall 49. Coupling each guide 78 to piston 46 provides the axial movement to guide 78 as piston 46 moves and the consequential radial movement of wedges 84 and fingers 64.

Figure 7D:
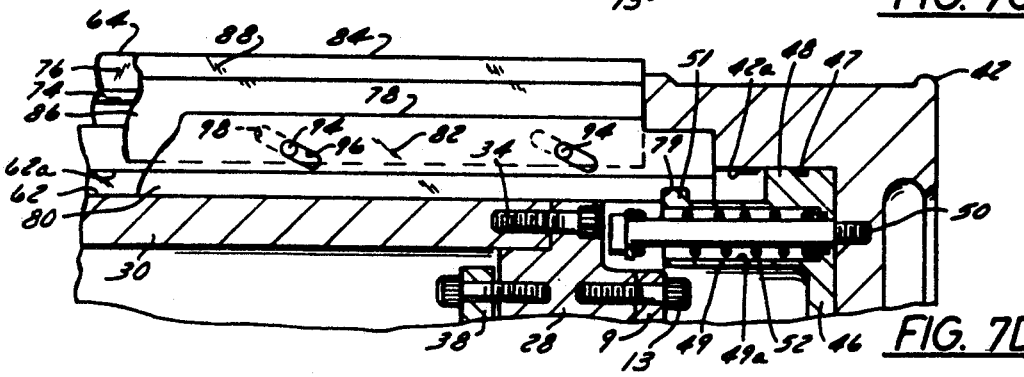

To best understand the operative sequence of collets 152 and 170, reference is made to FIGS. 7A–7D in which piston 46 is being moved from left to right, i.e. in the direction of end cap 42, by springs 52. In FIG. 7A, the air pressure within cylinder 45 formed by end cap 42 has caused piston 46 to be positioned as far to the left of end cap 42 as possible. In this position, the collet is in its contracted state. As the air pressure within cylinder 45 is reduced, piston 46 is urged to the right by springs 52. Guides 78 must follow due to the coupling interaction therebetween. The axial movement of guides 78 with respective guide slots 96 cause each roller 94 mounted therein to rotate up the surface of its respective slot 96, bearing against the upper surface of slot 98 of the associated wedge 84. Wedge 84, constrained for radial movement, only then moves radially upward as depicted by vertical arrows in FIG. 7B. Wedge side surfaces 88 then engage finger side surfaces engaging 76, causing concomitant upward radial movement of fingers 64. When piston 46 ceases further movement, and is positioned as illustrated in FIG. 7D, the collet is in its fully expanded condition (per FIG. 6).

The provision of paired slots 96, 98 and roller 94 to provide for the range of desired mechanical motions is preferred, but other mechanical coupling arrangements may be employed if desired. For example, arms 82 may be provided with a cylindrical cam member extending between the arms and through slot 98 in each wedge. As guide 78 moves, slot 98 follows the cylindrical cam and moves its respective wedge 84 in a radial direction. It is preferred, however, to ensure that radial motion of wedges (and fingers) is coordinated with the axial movement of guides. In the preferred paired slot arrangement, it has been found that a specified axial movement of the guides should cause the same vertical movement in the fingers. Thus, a 45° slot angle is preferred, although depending upon the precise application, other angles may be utilized. Adjustment of the slot angle changes the magnitude of relative movement between the guide and fingers.

To place the collet in a contracted state, cylinder 45 is charged with an appropriate air pressure through air valve 43 to overcome the resistance of springs 52. Initially, the condition of the collet is as is shown in FIG. 7D, with the piston head 48 adjacent to the interior surface of end cap 42. When air is charged in cylinder 45, piston 46 moves to the left, compressing springs 52 and engaging guide 78. The coupling interaction between guide 78 and respective wedge 84 causes wedge 84 to move radially inward, whereupon the outer periphery of the lower edge of wedge side surfaces 88 make abutting contact with shoulder 74 of adjacent fingers 64. Continued inward movement of wedge 84 causes similar movement of finger 64 until the respective side engaging surfaces 76 and 88 make contact as shown in FIG. 5, and further inward movement is prevented. The collet is thus returned to its contracted state as shown in FIG. 7A.

Referring again to FIG. 3, collets 152 and 170 are mounted to turret 154 for rotation by respective collet rotation motors 172 and 174 (only motor 174 is shown in FIG. 3). More specifically, turret 154 includes two openings (not shown) passing through turret 154. Rear shield members 25 of collets 152 and 170 rest against a face 155 of turret 154, with mandrel 12 fastened within one of the openings and one of a plurality of splined portions 11 of drive shaft 10 extending outward from the back of turret 154. Collet rotation motors 172 and 174 are fastened to the back side of turret 154 with the shafts thereof coupled to splined portions 11 of shafts 10 to controllably impart rotational motion to shafts 10.

Collet rotation motors 172 and 174 are suitably of a type which permit control of the rotational speed of collets 152, 170. By way of example only, collet rotation motors 172 and 174 can be Rexroth Indromat, MAC 2AD 132D motors which are each controlled by a motor control (1610 or 1612, FIG. 16) which can be a Rexroth Indromat KDA3.27 induction motor control. Motor controls 1610 and 1612 interface with a programmable controller 1600 as will be discussed.

Figure 3A:
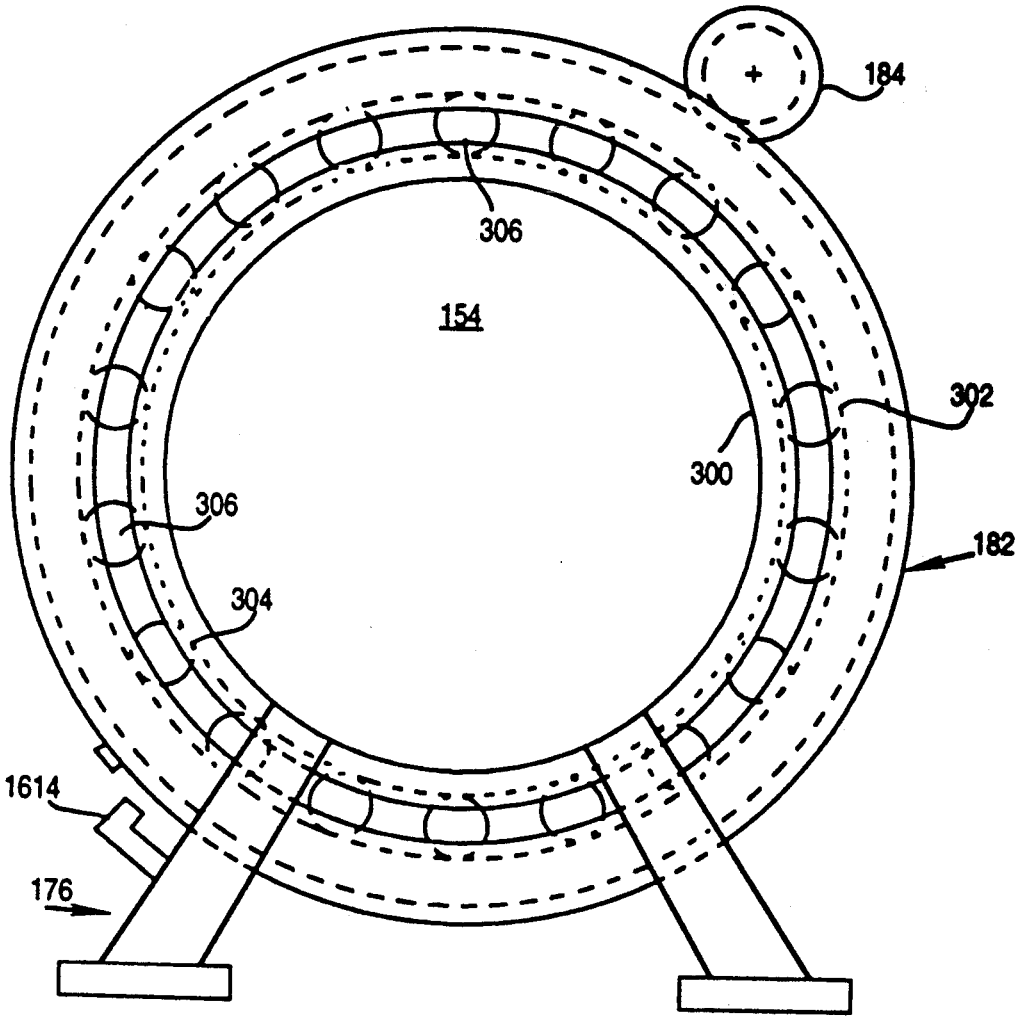
FIG. 3A is a schematic illustration of a turret gear support.

Turret 154 is rotatably mounted to support frame 176 via a turret drive gear 182 (schematically illustrated in FIG. 3A). An inner support ring 300 is mounted to support frame 176. Turret drive gear 182 includes an inside bearing surface 302, and inner support ring 300 includes an outside bearing surface 304. A plurality of cross rollers 306 are located between inside bearing surface 302 and outside bearing surface 304 to facilitate movement of the two surfaces relative to each other and thus rotation of turret 154 relative to support frame 176.

Turret 154 is capable of bi-directional rotation. More specifically, a turret drive gear 182 is mounted to turret 154. A cooperating gear 184, driven by turret drive motor 156 fixed to support frame 176, engages turret drive gear 182. The ratio of gear 184 to gear 182 is suitably 1 to 30. The operation of turret drive motor 156 and the engagement between turret drive gear 182 and gear 184 provide rotational motion to turret 154 and allows selective rotation of turret 154 in either the clockwise or counter-clockwise direction. Turret drive motor 156 is preferably a motor of the type which can hold turret 154 in a predetermined position without the aid of turret locking devices which are typically required in glass fiber winders. By way of example only, turret drive motor 156, is suitably a Rexroth Indromat, MAC 091A motor. A suitable gear reduction, e.g., provided by Rexroth Indromat, may be employed if desired.

Turret drive motor 156 is controlled by a motor control 1602, e.g., a Rexroth Indromat TDM 1.2 servo amplifier. Motor control 1602 interfaces with programmable controller 1600 as will be discussed.

Bearing surfaces 302 and 304, rollers 306, gear 182 and gear 184 are preferably lubricated with an oil mist spray. This spray is produced by a conventional oil spray system (not shown) including a spray nozzle, an oil pump, an oil supply, a control valve, and an oil supply line. The supply line connects the pump and nozzle such that a valve 1616 controls the supply of oil to the spray nozzle.

Figure 8A:
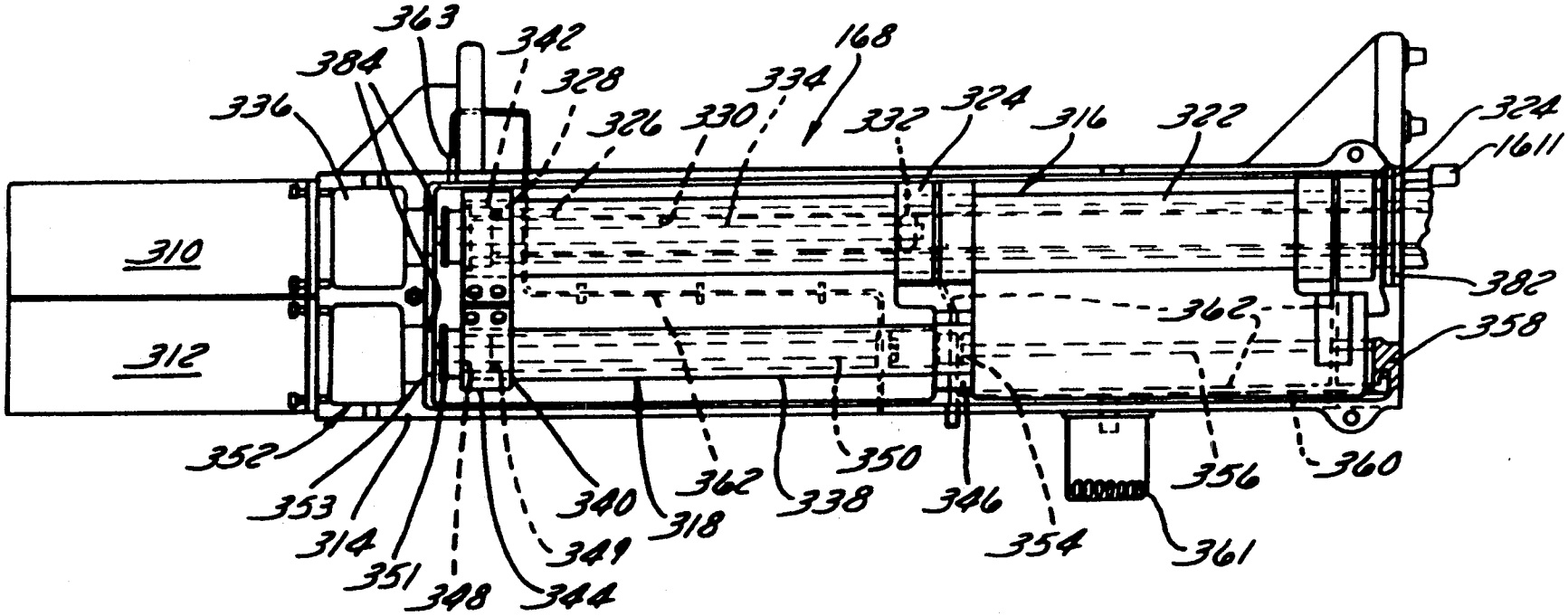
FIG. 8A is a side view of one portion of a traverse rotating and oscillating unit.
Figure 8B:
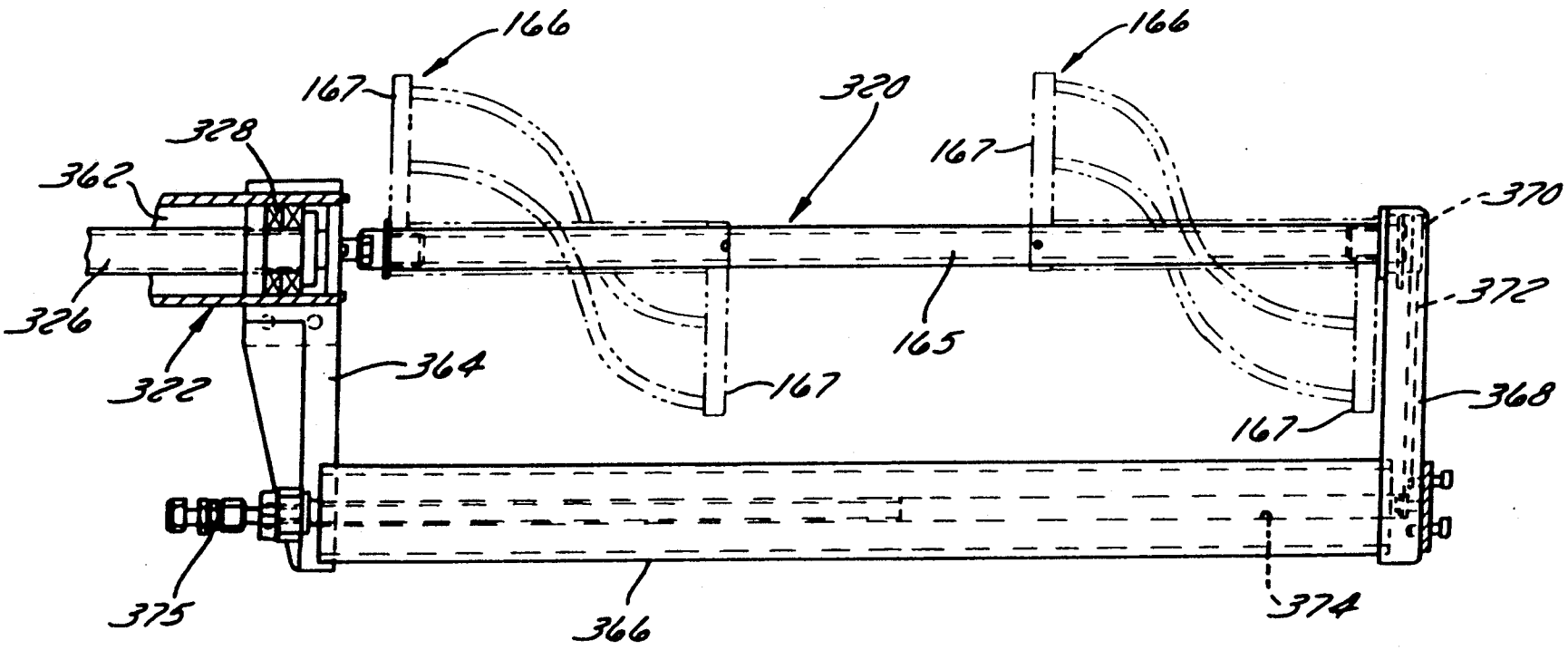
FIG. 8B is a side view of another portion of the traverse rotating and oscillating unit.
Figure 8C:
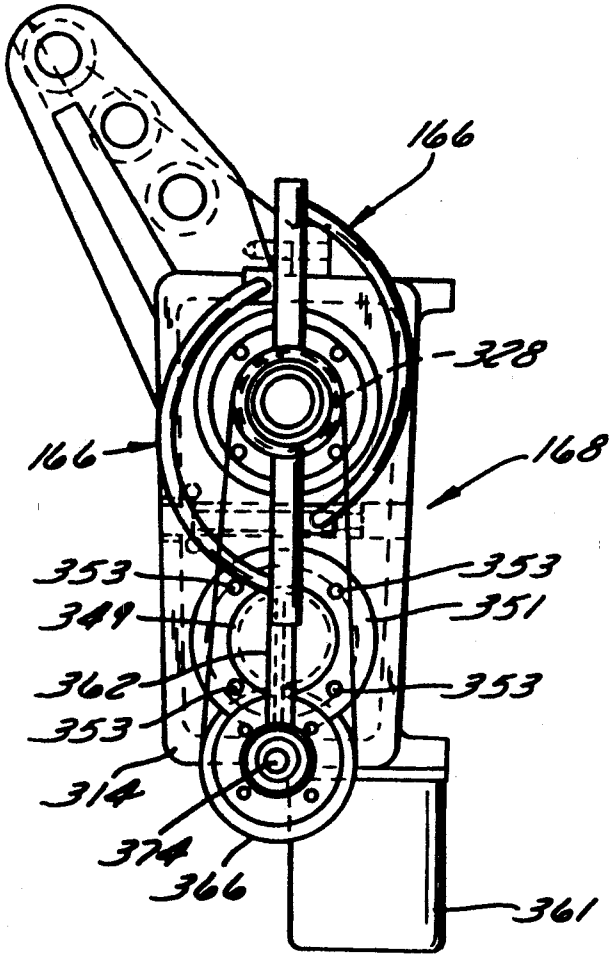
FIG. 8C is an end view of the traverse rotating and oscillating unit.

Referring now to FIGS. 8A–8C, traverse rotating and oscillating unit 168 serves to guide strands 178 onto cakes 180 and also prevent strands 178 from lying parallel on top of one another and causing strand-to-strand adhesion. Oscillating unit 168 suitably includes a traverse rotation servo motor 310 (FIG. 8A), an oscillating servo motor 312 (FIG. 8A), a cast housing 314, a spiral drive tube assembly 316 (FIG. 8A), a spiral torque tube assembly 318, and an outboard spiral assembly 320. (FIGS. 8B and 8C).

By way of example only, servo motors 310, 312 can be Rexroth Indromat, MAC 071A motors. A suitable gear reduction is provided by Rexroth Indromat. As will be hereinafter described in conjunction with FIG. 16, motors 310 and 312 are each controlled by a pair of motor controls 1606 and 1608, e.g., Rexroth Indromat TDM3.2 servo amplifiers, interfaced with programmable controller 1600.

Referring to FIG. 8A, spiral drive tube assembly 316 includes a main support tube 322 which is supported within housing 314 on a pair of linear bearings 324 such that support tube 322 can translate along its longitudinal axis in and out of housing 314. A spiral drive shaft 326 is mounted within support tube 322 upon a pair of roller bearings 328. Spiral drive shaft 326 is a hollow shaft which includes a splined portion 330 machined into the inside surface of drive shaft 326. Splined portion 330 is engaged by a splined portion 332 of a motor drive shaft 334 which is, in turn, coupled to traverse rotation motor 310 by a suitable coupling arrangement 336, e.g., a Rexroth MC7C200 coupling. Arrangement 336 rotatably supports the left end of motor drive shaft 334.

Spiral torque tube assembly 318 includes a drive tube 338 which has a first end 340 fixed to an end 342 of support tube 322 by a torque arm 344. Torque arm 344 is clamped to the outside surfaces of support tube 322 and drive tube 338. Drive tube 338 is also supported by a linear bearing 346 located substantially at the bottom center of housing 314. A threaded lead screw follower 348 is fixed within drive tube 338 at its first end 340. Lead screw follower 348 is engaged by a lead screw 350 which is coupled to oscillating motor 312 and supported at its left end by a coupling arrangement 352. Excluding the inner surface of drive tube 338 occupied by lead screw follower 348, the inner surface is machined to form a cylinder which can reciprocate over a piston 354.

Lead screw follower 348 includes a hub 349 fastened to a flange 351. The outside diameter of hub 349 is substantially the same as the inside diameter of drive tube 338. The inside surface of hub 349 is provided with threads suitable to mate with the threads of lead screw 350. Flange 351 includes four holes adapted to each accept a bolt 353. First end 340 includes threaded holes each adapted to accept one bolt 353 such that bolts 353 fix follower 348 to first end 340.

Piston 354 is mounted upon a hollow tube 356 which is supported by an oil port 358. Tube 356 provides a conduit from piston 354 to oil port 358. Oil port 358 includes a valve which provides a conduit to a tube 360 coupled to an oil filter 361 (C.S. FRAM PF-47) or to the bottom of housing 314. From the oil filter, additional tubing 362 is provided to an oil nozzle 363 at the top of housing 314, linear bearings 324, and linear bearing 346. Oil nozzle 363 lubricates splined portion 330.

Outboard spiral assembly 320 is clamped to the second end 362 of support tube 322 with an arm 364. Arm 364 is fixed to a horizontal fluid filled tube 366 which is, in turn, fixed to an outboard bearing support 368. Bearing support 368 supports a plastic spiral shaft bearing 370. Bearing support 368 includes a fluid channel 372 for supplying fluid to spiral shaft bearing 370 which communicates with a fluid channel 374 of horizontal tube 366. Fluid channel 374, in turn, communicates with a quick connect coupling 375 supported by arm 364. The coupling is designed to engage a water supply line. Fluid filled tube 366 dampens vibrations caused by the engagement of spirals 166 with the glass fibers during winding. The water provided to tube 366 provides a dampening mass in tube 366 as well as a lubrication supply for bearing 370.

A spiral shaft 165 is coupled to and supported by spiral drive shaft 326 at its first end and rotatably supported by spiral shaft bearing 370 at its second end. Respective spirals 166, suitably fabricated from helically shaped plastic rod in the configuration illustrated in FIG. 8B, are mounted to shaft 165 with a plurality of rods 167.

In general, oscillating unit 168 functions to rotate spiral shaft 165 at about 1500 rpm while simultaneously translating outboard spiral assembly 320. With reference to FIGS. 8A and 8B, motor 310 rotates motor drive shaft 334, which imparts rotational motion to spiral drive shaft 326, and thus shaft 165, via the interaction of splined portion 332 and splined portion 330. The use of splined portions 330 and 332 allow spiral drive tube assembly 316 to translate within linear bearings 324 while rotation motor 310 is imparting rotational motion to spiral drive shaft 326.

Servo motor 312 is controlled by programmable controller 1600 such that lead screw 350 can be rotated in both directions. By rotating lead screw 350 in both directions, drive tube 338 can be translated to the left and right such that spiral drive tube assembly 316 is translated into and out of housing 314 via torque arm 344. When drive tube 338 is translated, the volume of a chamber 378 created within drive tube 338 between lead screw follower 348 and piston 354 changes. This change in volume causes a valve 380 of oil port 358 to either port oil from the bottom of housing 314 into chamber 378 or port oil from chamber 378 to oil filter 361. When lead screw 350 is rotated by motor 312 such that drive tube 338 is driven to the right, as illustrated in FIG. 8A, the volume of oil chamber 378 is decreased and oil is forced into filter 361 and through the conduits which lubricate linear bearings 324, 346 and supply oil to the top portion of housing 314. When a lead screw 315 is rotated to move drive tube 356 to the left, oil is drawn into chamber 378 via oil port 358 from the bottom of housing 314.

A spiral scrapper and seal assembly 382 (FIG. 8A) is supported by housing 314 about support tube 322 such that support tube 322 can translate into and out of housing 314 without substantial oil loss at tube 322. A pair of oil seals 384 are supported by housing 314 about lead screw shaft 350 and motor drive shaft 334 at the locations where these two shafts exit housing 314 for purposes of being coupled to motors 310 and 312.

Oscillating unit 168 also includes an inductive pickup 1611 (FIG. 8A) which provides a pulse to controller 1600 (FIG. 16) when outboard spiral assembly 320 is retracted toward its initialization position and arm 364 (FIG. 8B) passes pickup 1611. The purpose of pickup 1611 is to allow for re-initialization of outboard spiral assembly 320 every time a strand transfer takes place during winding.

Figure 9C:
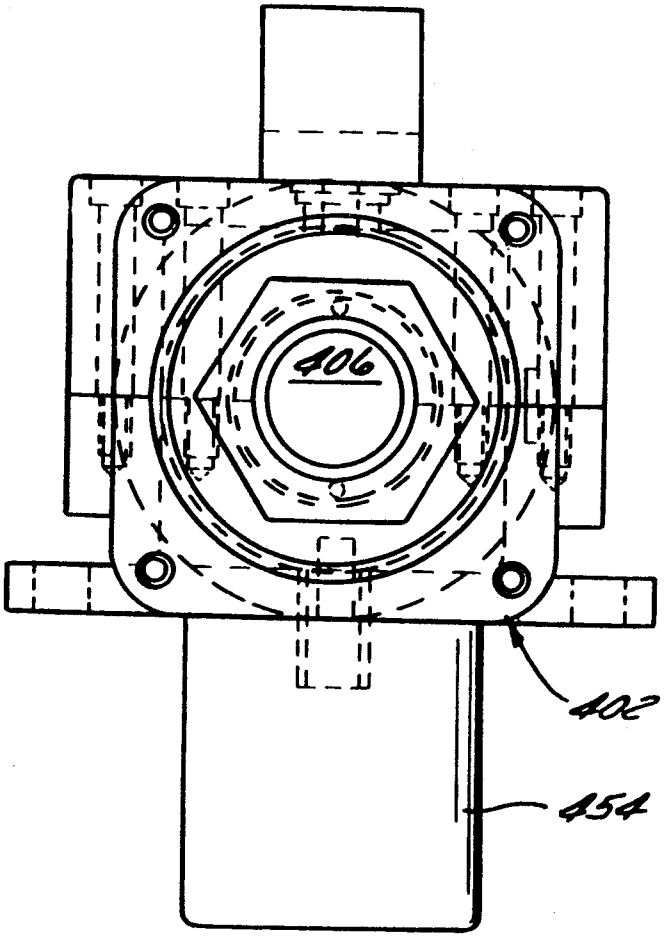
FIG. 9C is an end view of the strand splitter oscillating unit.
Figure 9A:
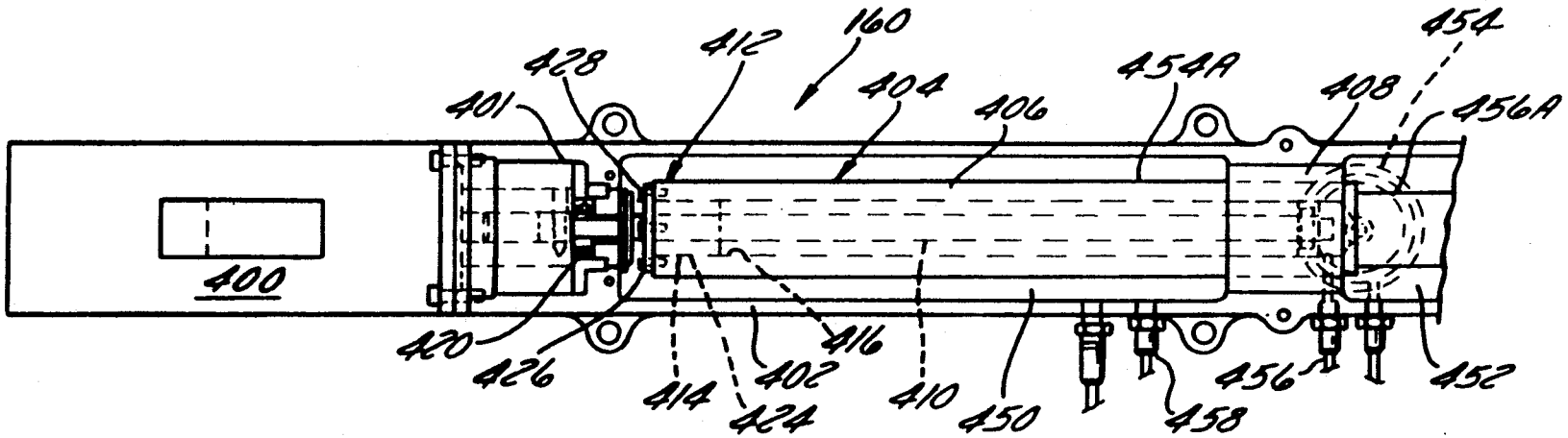
FIG. 9A is a top view of one portion of a strand splitter oscillating unit.
Figure 9B:
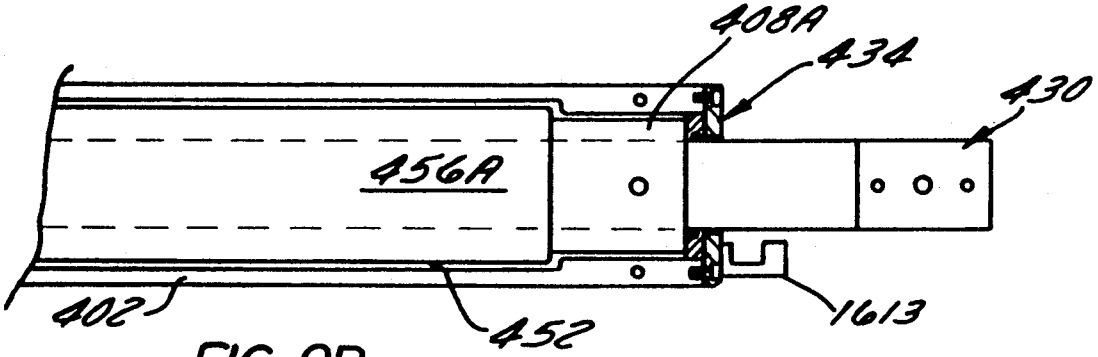
FIG. 9B is a top view of another portion of the strand splitter oscillating unit.

Referring to FIGS. 9A, 9B and 9C, lower strand splitter oscillating unit 160 includes an oscillating servo motor 400 (FIG. 9A), e.g., a Rexroth Indromat, MAC 071A motor, a cast aluminum housing 402, and a splitter oscillating assembly 404. Motor 400 is controlled by a motor control 1604 (FIG. 16) which interfaces with programmable controller 1600 as will be discussed. By way of example, motor control 1604 may be a Rexroth Indromat TDM 3.2 servo amplifier, and motor 400 may be used with a suitable Rexroth Indromat gear reduction.

Splitter oscillating assembly 404 includes a reciprocating splitter shaft 406. Shaft 406 is supported in a housing 407, by a plurality of linear bearings 408 and 408A such that shaft 406 can translate along its longitudinal axis into and out of housing 402. A first end 412 (FIG. 9A) of shaft 406 includes a threaded lead screw follower 414 fixed within a cylinder 416 of shaft 406. The other end of shaft 406 also includes a splitter mounting portion 430 (FIG. 9B) for mounting splitter 162.

Lead screw follower 414 includes a hub 424 fastened to a flange 426. The outside diameter of hub 424 is substantially the same as the inside diameter of cylinder 416. The inside surface of hub 424 is provided with threads suitable to mate with the threads of a lead screw 410. Flange 426 includes four holes adapted to each accept a bolt 428. First end 412 of shaft 406 includes threaded holes each adapted to accept one bolt 428 such that bolts 428 fix follower 414 to first end 412.

Lead screw follower 414 is engaged by lead screw 410 which is coupled to motor 400 by a suitably coupling arrangement 401 (for example, Rexroth MC7C200) and supported by a roller bearing 420.

In operation, oscillating unit 160 functions to oscillate splitter 162 substantially in unison with outboard spiral assembly 320. Motor 400 is controlled by programmable controller 1600 (FIG. 16) such that lead screw 410 can be rotated in both directions. By rotating lead screw 410 in both directions, shaft 406 can be translated to the left and right such that splitter 162 translates substantially above outboard spiral assembly 320.

Assembly 404 also includes a lubricating system comprising shaft 406, respective chambers 450 and 452, an oil filter 454 (Fram PF-47), respective oil line 456 and 458, and oil passages to linear bearing 408 (not shown). The volume of oil in chambers 450 and 452 is defined by the volume of chambers 450 and 452 less the volume displaced by shaft 406. More specifically, with shaft 406 positioned as illustrated in FIGS. 9A and 9B, the volume of oil in chamber 450 is at its lowest value, while the volume of oil in chamber 452 is at its highest.

To facilitate oil transfer between chambers 450 and 452, shaft 406 has a large diameter portion 454A and a small diameter portion 456A. Accordingly, when shaft 406 is translated out of housing 402, large diameter portion 454A displaces oil from chamber 452. The displaced oil is forced into linear bearing 408A, then through an oil passage (not shown) to filter 454, and finally through line 456 to chamber 450. When shaft 406 translates back into housing 402, large diameter portion 454A displaces oil from chamber 450. The displaced oil is forced through line 458 into linear bearing 408 and then into chamber 452.

A seal assembly 434 is supported by housing 402 about shaft 406 such that shaft 406 can translate into and out of housing 402 without oil loss.

Oscillating unit 160 also includes an inductive pickup 1613 (FIG. 9B) which provides a pulse to controller 1600 (FIG. 16) when mounting portion 430 is retracted to its initialization position and portion 430 passes pickup 1613. Pickup 1613 allows for re-initialization of portion 430 every time a strand transfer takes place during winding.

In another embodiment of the fiber winder, oscillating unit 160 can be eliminated by mounting splitter 162 directly to outboard spiral assembly 320. This arrangement ensures that the splitter moves in unison with outboard spiral assembly 320, but does not permit the operator of the fiber winder to provide a lead or lag in oscillating movement between splitter 162 and outboard spiral assembly 320. Using a separate oscillating unit 160, programmable controller 1600 can be programmed such that oscillating units 168 and 160 oscillate outboard spiral assembly 320 and splitter 162 independently relative to collets 152, 170 to improve or adjust the winding characteristics of the fiber winder.

In FIG. 3, collets 152, 170 are illustrated, for purposes of clarity, without a winding shield. As previously discussed, a non-movable winding shield 1026 (FIGS. 2A-2E) can be interposed between the rotating collets to prevent water and size (applied to a strand being wound on the rotating collet) from being deposited on the stationary collet. One problem with winding shield 1026 is that it interferes with the transfer of strand between collets and requires movement of the strand to the end of collets to avoid the shield 1026 during the transfer. This movement often causes strand breakage.

Referring to FIGS. 10A, 10B, 11A and 11B, a first embodiment of a movable winding shield 190 is interposed between collets 152, 170. Winding shield 190 is a two part shield including a stationary portion 192 and a rotatable portion 194. Stationary portion 192 is fixed to turret 154 with a pair of flanges 195, interposed between collets 152 and 170 with a central axis 196 coincident with the central longitudinal axis of turret 154, and thus parallel with central longitudinal axes A5 and A4 of the collets 152, 170. Stationary portion 192 is fabricated from a substantially flat piece of sheet metal to include a central portion 200, a first side flange 202 extending at a predetermined angle from one side of central portion 200, e.g., about 130°, and a second side flange 204 extending from the other side of central portions 200 at a predetermined angle, e.g., about 130°. A plurality of rubber seals 234 are disposed on each of side flanges 202 and 204 for interaction with rotatable portion 194 as will be discussed. Flanges 195 connect each of side flanges 202, 204 to turret 154.

Rotatable portion 194 is also fabricated from a flat piece of sheet steel to include a bottom portion 206, an intermediate portion 208, and a top portion 210. Intermediate portion 208 extends upwardly from bottom portion 206 at a predetermined angle, e.g., about 140°. Top portion 210 extends upwardly from intermediate portion 208 at a predetermined angle, e.g., about 160°, and terminates at a collar 212. Collar 212 is fixed upon a rotation shaft 214 and includes a series of water jets 216.

Water jets 216 are supplied with water from an ON/-OFF valve 1622 which is controlled by programmable controller 1600 as discussed below. The purpose of the water streams from jets 216 is to rinse debris and size from rotatable portion 194.

Rotation shaft 214 suitably includes a lever arm 220 and is rotatably supported by a pair of bearings 218 mounted relative to frame 176. Lever arm 220 is fixed, e.g., welded, to rotation shaft 214 at one end of rotation shaft 214 such that bearings 218 are located between lever arm 220 and collar 212.

The rotation of rotation shaft 214, and thus the rotation of rotatable portion 194, is controlled by a pneumatic cylinder 222. Pneumatic cylinder 222 is controlled by a valve 1620 operated by the control system discussed below.

Figure 16:
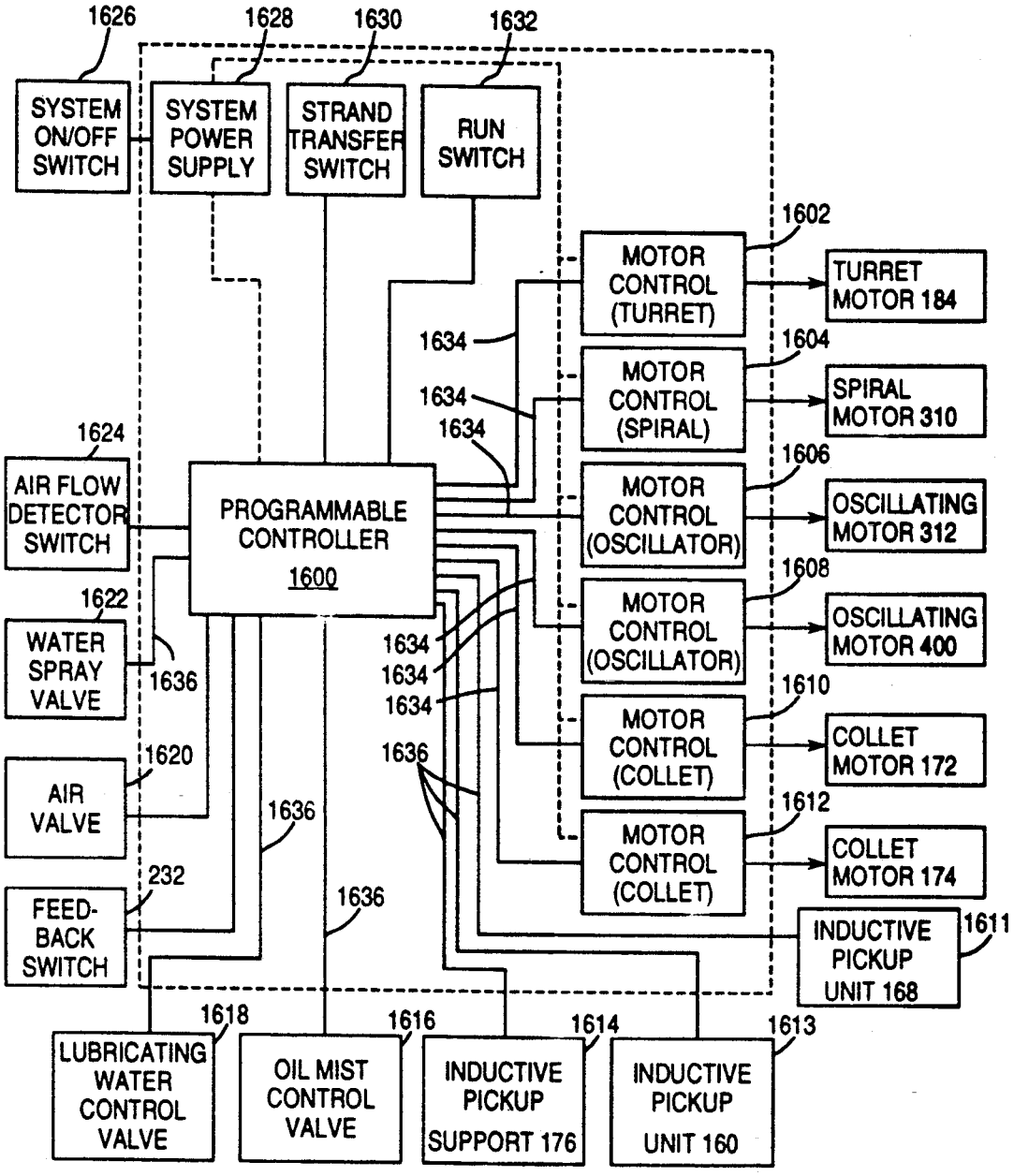
FIG. 16 is a block diagram of the control system for the winder.

Pneumatic cylinder 222 includes a ram 236 pivotally attached to an end 224 of lever arm 220. When pressurized, due to the activation of air valve 1620, pneumatic cylinder 222 causes rotation shaft 214 to rotate in the clockwise direction until an opposite end 226 of lever arm 220 comes in contact with a stop flange 228. Stop flange 228 includes an adjustment bolt 230 and a feed-back switch 232. Adjustment bolt 230 is adjusted to vary the limit of rotation of rotation shaft 214 in the clockwise direction, and feed-back switch 232 provides a binary (OPEN/CLOSED) signal to programmable controller 1600 (FIG. 16).

When rotatable portion 194 is in its winding position (FIGS. 10A and 11A), bottom portion 206 contacts one of the rubber seals 234 fixed along second side flange 204. Since stationary portion 192 is fixed between collets 152 and 170, the seal 234 contacted by portion 206 will depend upon the rotation of turret 154, e.g. one of seals 234 will be contacted when collet 154 is in the winding position and the other seal 234 will be contacted when collet 170 is in the winding position. Additionally, portion 206 contacts seals 234 such that turret 154 can rotate slightly during winding (for purposes of maintaining the proper angle between strand 178 and the collet it is being wound onto) without disengaging portion 206 and one of seals 234. Pneumatic cylinder 222 ram 236 is retracted, to force bottom portion 206 against rubber seal 234 to form a relatively water tight seal and maintain contact therebetween.

Figure 10B:
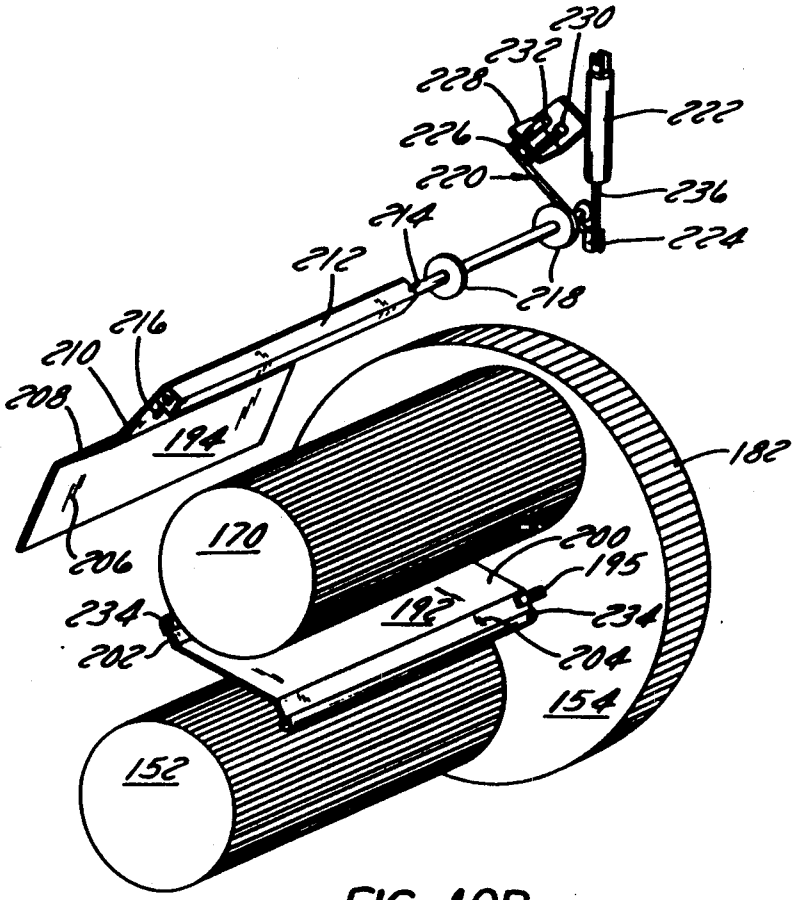
FIG. 10B is a perspective view of the first embodiment of a movable winding shield in its transfer position.
Figure 10A:
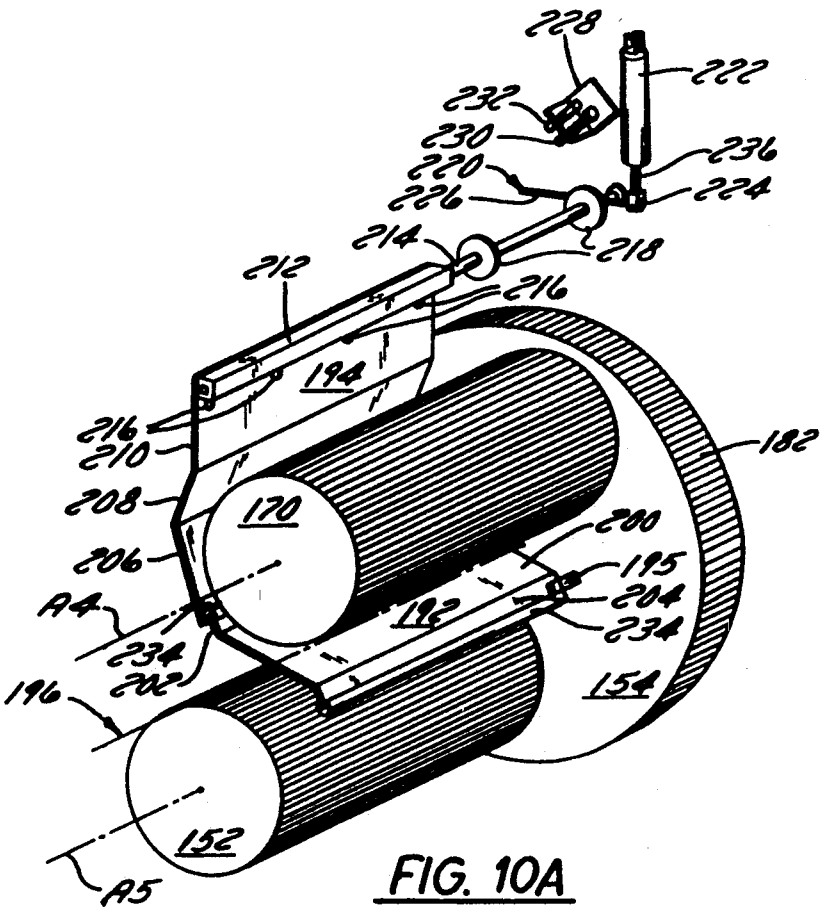
FIG. 10A is a perspective view of a first embodiment of a movable winding shield in its winding position.
Figure 11B:
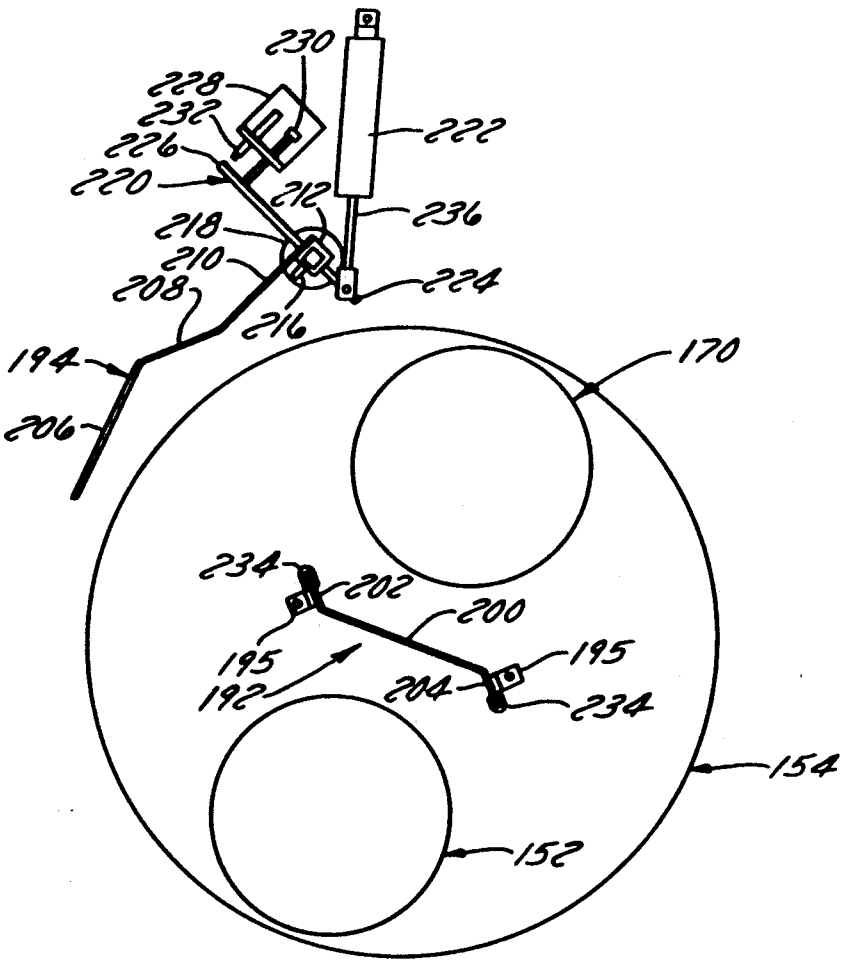
FIG. 11B is a side view of the first embodiment of a movable winding shield in its transfer position.
Figure 11A:
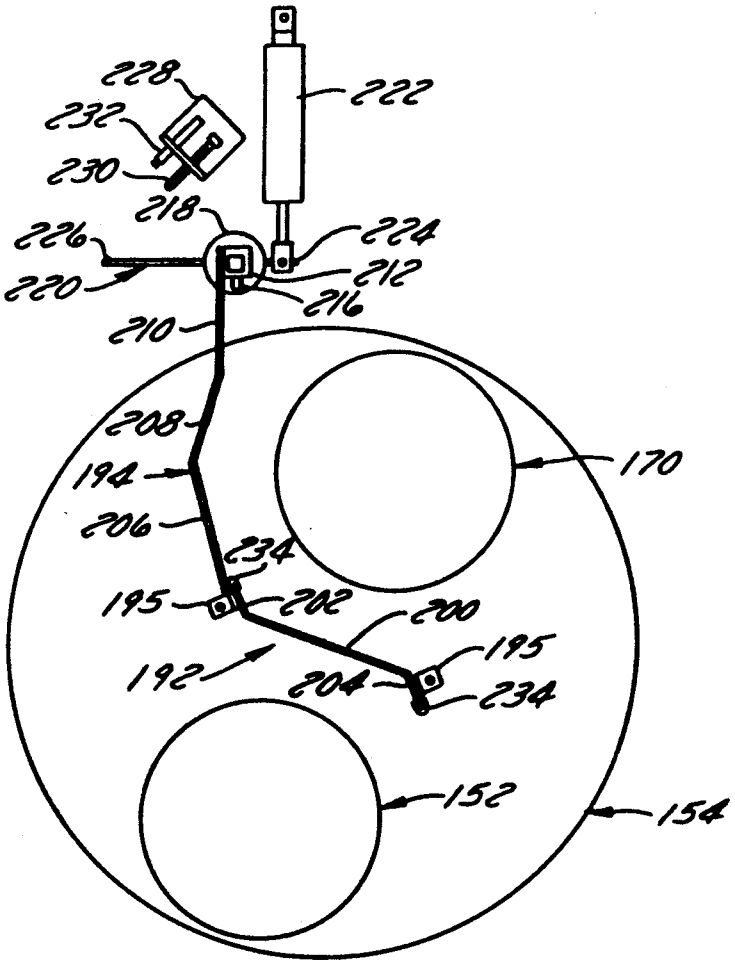
FIG. 11A is a side view of the first embodiment of a movable winding shield in its winding position.

When turret 154 is to be rotated, rotatable portion 194 is moved into its transfer position. Referring to FIGS. 10B and 11B, ram 236 of pneumatic cylinder 222 is extended such that one end of lever arm 220 rotation shaft 214 until lever arm 220 is forced against adjustment bolt 230.

Figure 12C:
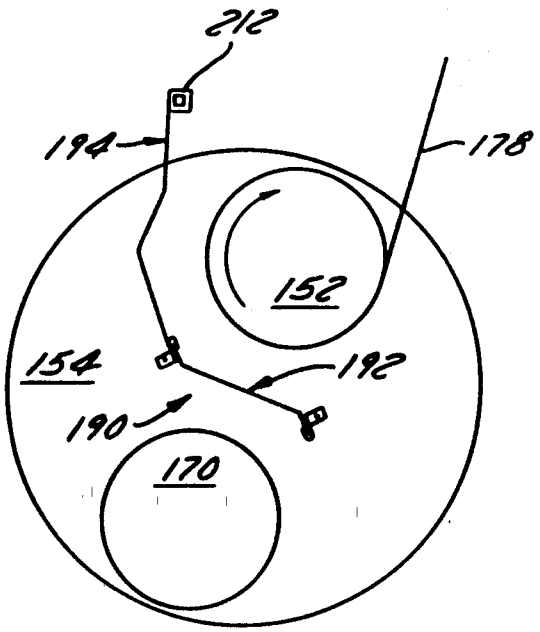
FIGS. 12A–12C illustrate the process of transferring a strand from one collet to the other in conjunction with operating the winding shield of FIGS. 10A–11B.
Figure 12B:
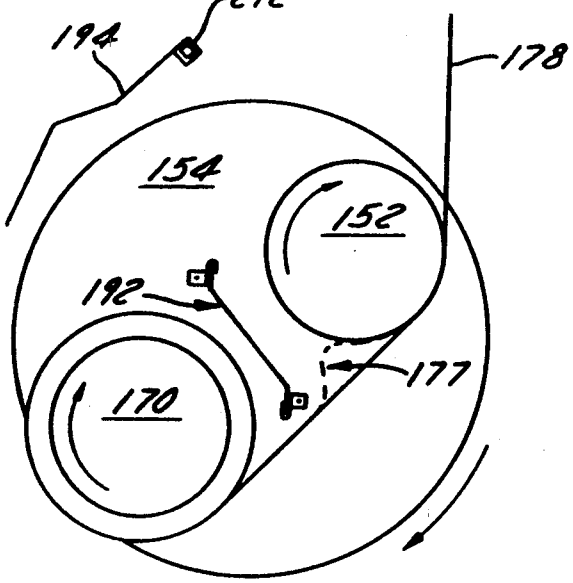

Selective rotation of portion 194, between its winding position and transferring position (FIG. 12A–12C), permits transferring strand 178, from e.g., collet 170 to collet 152, without forcing strand 178 to the end of collets 152, 170 when making the transfer. When strand 178 is being wound upon a first collet, e.g., collet 170, and cake 180 reaches a predetermined size, turret 154 is rotated to put strand 178 in contact with the other collet, e.g., collet 152. To implement the transfer, the turret is rotated in the clockwise direction. Rotatable portion 194 is also rotated in the clockwise direction such that winding shield 190 does not interfere with collet 152. Referring to FIG. 12B, collet 152 comes into contact with strand 178. At that point strand 178 continues to be wound onto collet 170. However, at this stage of the transfer process, the rotational speed of collet 152 is decreased. This causes a loop 177 to form in strand 178, increasing the angle of wrap about collet 152 (shown by dashed line). When the wrap angle between strand 178 and collet 152 becomes sufficiently large, strand 178 begins winding upon collet 152, breaking strand 178 between collets 152 and 170 to discontinue upon collet 170. Referring to FIG. 12C, after contact is established between strand 178 and collet 152, rotatable portion 194 is rotated counter clockwise by rotation shaft 214 into engagement with rubber seal 234 on side flange 204.

Figure 12A:
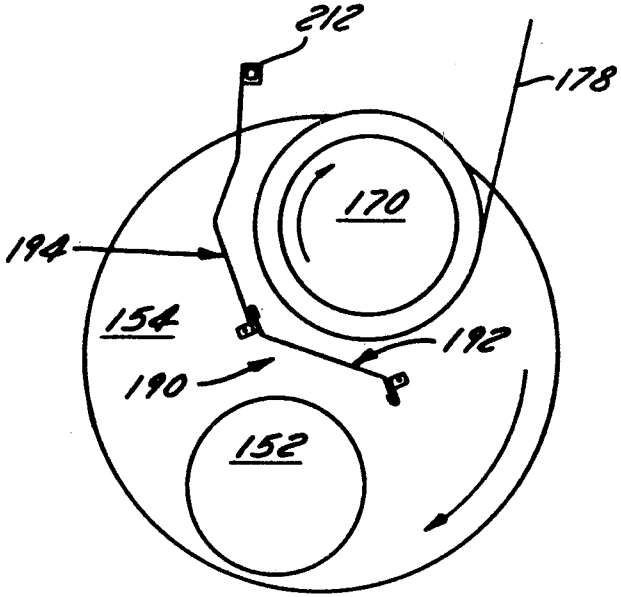
Figure 13B:
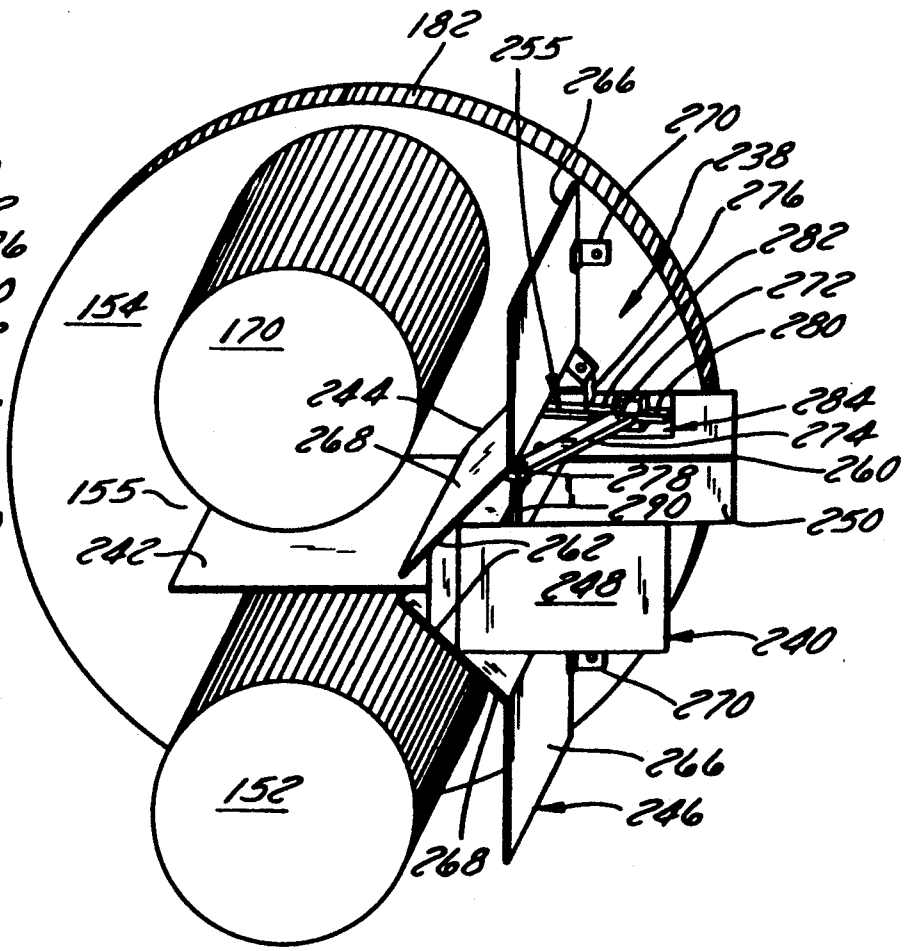
FIG. 13B is a perspective view of the second embodiment of a movable winding shield in its transfer position.
Figure 13A:
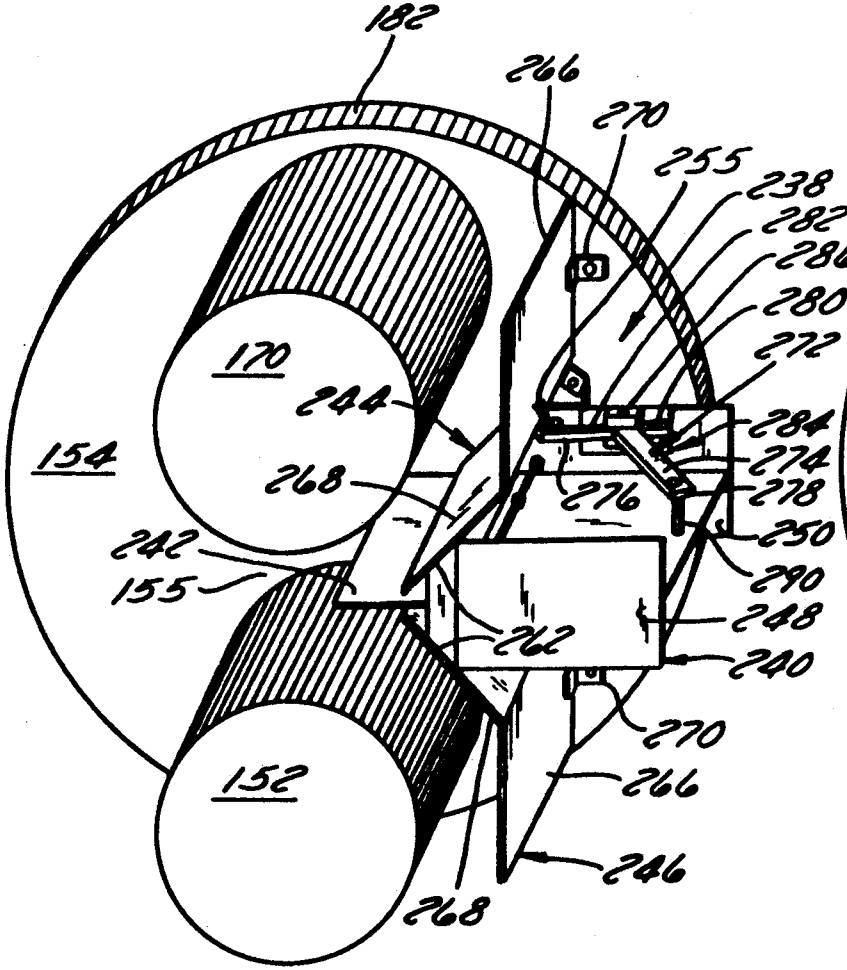
FIG. 13A is a perspective view of a second embodiment of a movable winding shield in its winding position.

After the amount of strand 178 wound about collet 152 reaches a predetermined limit, the process of transferring strand 178 between collets will be restarted and the steps discussed in reference to FIGS. 12A and 12B repeated.

Referring to FIGS. 13A, 13B, 14A and 14B, a second embodiment of moveable winding shield, 238 of FIG. 13, will be described. Moveable winding shield 238 includes a stationary shield unit 240 and a retractable shield portion 242.

Stationary shield unit 240 includes: a first and second shield 244 and 246; a first and second side support guide 248 and 250; a pivoting T-arm 272; a pneumatic cylinder 254 housing a ram 255; a plurality of water spray nozzles 256; and a shield guide 258.

Side support guides 248 and 250 have substantially the same configuration and are disposed in a parallel side-by-side relationship. Each support guide 248 and 250 is fabricated from a single sheet of sheet steel, including a guide channel 260, adapted to slidably support retractable shield portion 242.

Figure 14B:
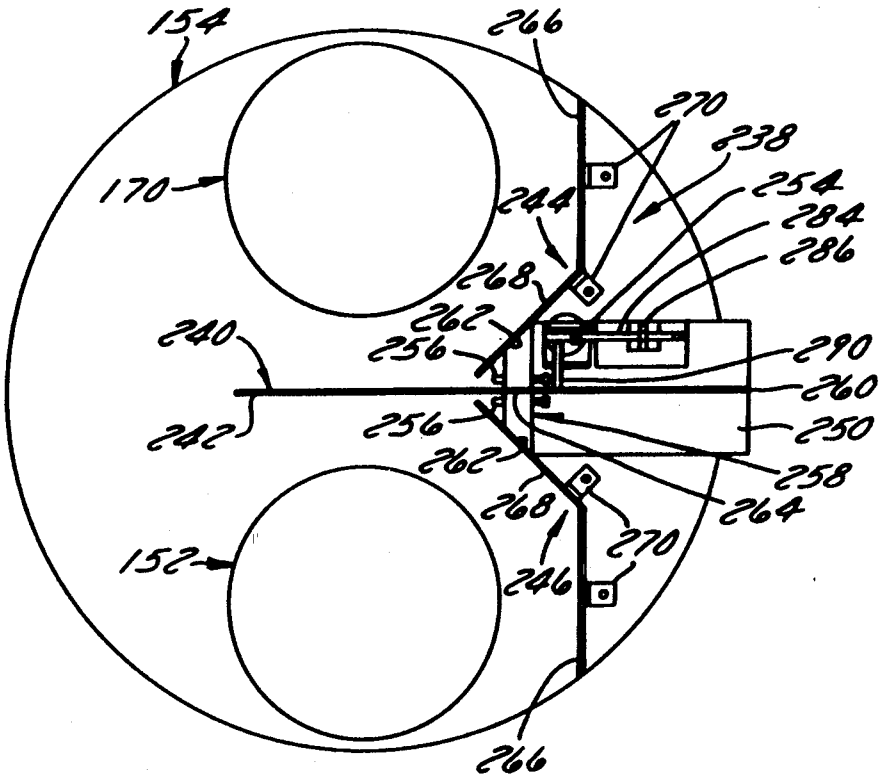
FIG. 14B is a side view of the first embodiment of a movable winding shield in its transfer position.
Figure 14A:
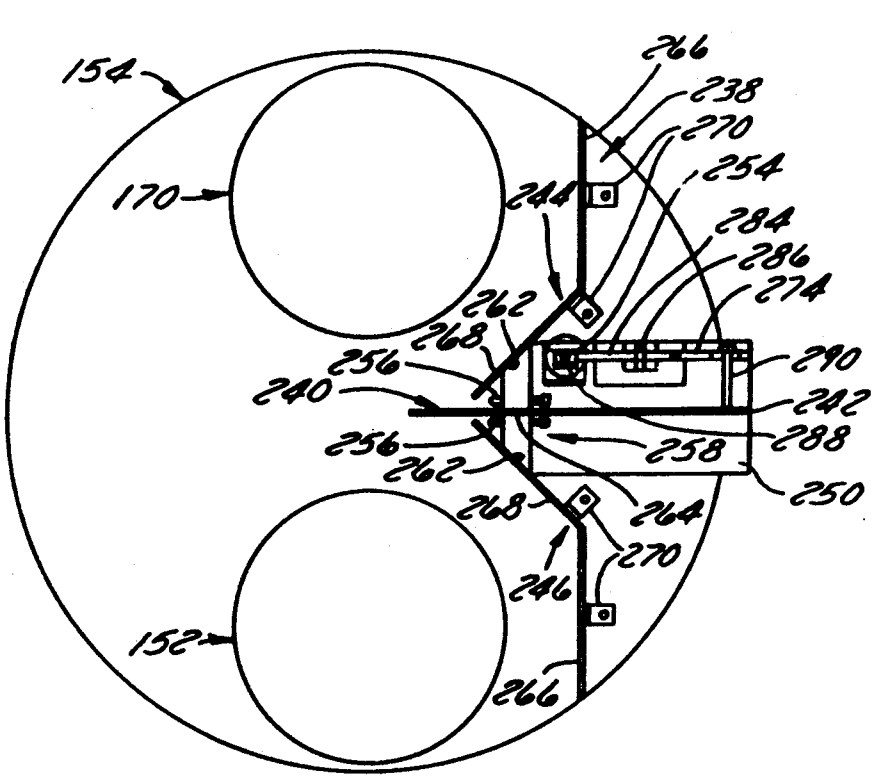
FIG. 14A is a side view of the second embodiment of a movable winding shield in its winding position.

As best seen in FIGS. 14A and 14B, shield guide 258 maintains side support guides 248 and 250. Shield guide 258 is suitably fabricated from bar stock having a rectangular cross-section, with angle surfaces 262 on its top and bottom, and a guide opening 264 disposed at its central axis. Angle surfaces 262 are cut from the bar stock at a predetermined angle, e.g., approximately 45°, from the front surface of the bar stock. Guide opening 264 has substantially the same size and shape as the cross-sectional size and shape of retractable shield portion 242. Shield guide 258 is secured, e.g., welded, between side support guides 248 and 250 with guide opening 264 aligned with guide channels 260. By properly aligning guide opening 264 and guide channels 260, the retractable shield portion 242 is permitted to slide within guide opening 264 and along guide channels 260.

Shields 244 and 246 suitably have substantially the same configuration, each fabricated from a single piece of sheet steel to include first and second portions 266 and 268 of substantially the same size. Portion 266 extends from second portion 268 at a predetermined included angle, e.g., approximately 135°. Second portions 268 are each welded to respective angle surfaces 262 suitably such that shields 244 and 246 are oriented as illustrated in FIGS. 13A, 13B, 14A and 14B.

Shields 244 and 246 each include a pair of tabs 270 to fix the moveable winding shield 238 to turret 154. One leg of each tab 270 is fixed, e.g., welded, to one of shields 244, 246 and the other leg is secured, e.g., bolted, to turret 154.

Pivoting T-arm 272, is suitably fabricated from bar stock, and includes a shield drive member 274, and a control member 276. Drive member 274 includes a drive pin translation slot 278 at one end and is fixed, e.g., welded, to control member 276 at the other. Control member 276 includes a pivot hole located in the vicinity of drive member 274, a stop arm 280 and a control arm 282. T-arm 272 is pivotally attached to side support guide 250 by a pivot pin support 284 and a pivot pin 286.

Pneumatic cylinder 254 is fastened to the rear of turret 154 such that the longitudinal axis of pneumatic cylinder 254 is perpendicular to face 155 of turret 154. Ram 255 passes through registered openings in turret 154 and side support 250 and is pinned to control arm 282 with a pin 288 which passes through a pin opening at the end of control arm 282.

Drive pin translation slot 278 engages a drive pin 290 fixed to retractable shield portion 242. When pneumatic cylinder 254 moves ram 255, T-arm 272 moves drive pin 290 to extend and retract shield portion 242 depending upon the direction in which ram 255 moves. More specifically, when ram 255 moves outward from pneumatic cylinder 254, T-arm 272 pivots about pivot pin 286 to retract shield portion 242, and when ram 255 moves into pneumatic cylinder 254, T-arm 272 pivots about pivot pin 286 to extend shield portion 242. The motion of pneumatic cylinder 254 is controlled by air valve 1620 as discussed below.

Stationary shield unit 240 includes, in addition to nozzles 256, shield guide 258 which supports nozzles 256 on both sides of shield portion 242 (FIGS. 14A and 14B). Nozzles 256 are supplied with water at a pressure of about 40 psi by a suitable water supply (as shown). The spray from nozzles 256 serves to clear the top and bottom surfaces of shield portion 242 of debris and size so that shield portion 242 can be retracted into shield guide 258. Water valve 1622 is used to control the flow of water to nozzles, and the valve is controlled by programmable controller 1600 as discussed below.

Figure 15A:
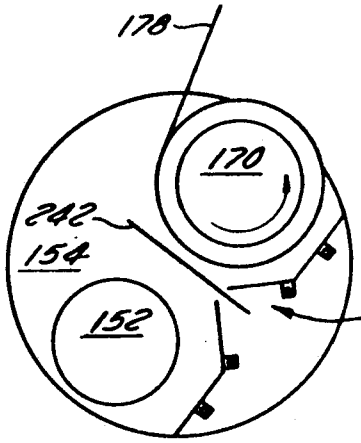
FIGS. 15A–15E illustrate the process of transferring a strand from one collet to the other in conjunction with operating the winding shield of FIGS. 13A–14B.
Figure 15B:
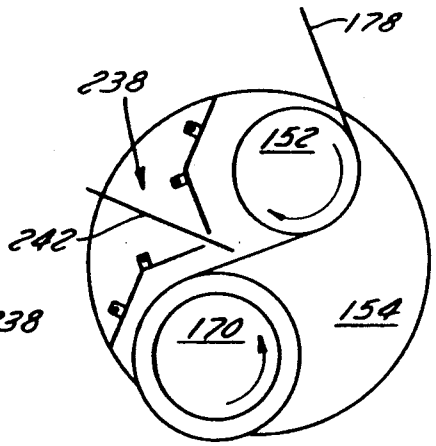

Selective rotation of shield portion 242 between its extended and retracted position permits transferring strand 178 from collet 170 to collet 152 without forcing strand 178 to the end of collets 152, 170 when making the transfer. When strand 178 is being wound upon collet 170 and is at a point where cake 180 is of such a size that turret 154 must be rotated to put the strand in contact with collet 152. To implement the transfer, turret 154 is rotated in the clockwise direction to an over-rotated position while shield portion 242 is retracted to avoid interfering with strand 178 as illustrated in FIG. 15B. During the transfer, collets 152, 170 are rotating in opposite directions.

Figure 15C:
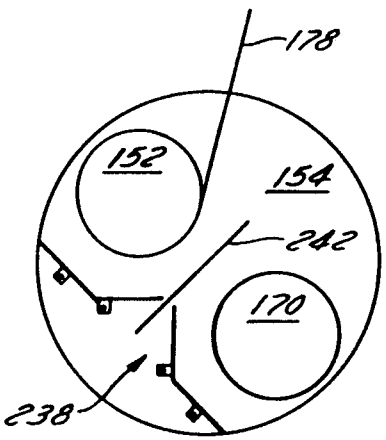
Figure 15D:
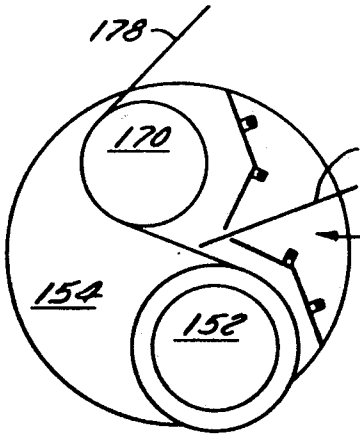

After turret 154 is rotated to the over-rotated position, turret 154 is rotated counter-clockwise back to a start position for collet 152. During this rotation of turret 154, the surface speeds of collets 152, 170 are caused to differ by appropriately controlling the speeds of collet rotation motors 172 and 174. The difference in collet surface speeds breaks the strand 178 to complete the transfer of strand 178 to collet 152. In addition to differing the collet rotational speeds while turret 154 is rotating to the start position for collet 152, shield portion 242 is extended back between collets 152, 170 as illustrated in FIG. 15C.

Turret 154 is rotated counter-clockwise to an over-rotated position while shield portion 242 is retracted to avoid interfering with strand 178, when cake 180 on collet 152 is of such a size that turret 154 must be rotated to put strand 178 in contact with collet 170. During the transfer, collets 152, 170 are rotating in opposite directions.

Figure 15E:
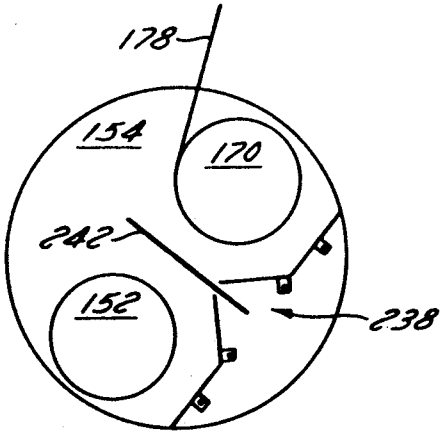

After turret 154 is rotated to the over-rotated position, turret 154 is rotated clockwise back to a start position for collet 170. During this rotation of turret 154, the surface speeds of collets 152, 170 are caused to differ by appropriately controlling the speeds of collet rotation motors 172 and 174. The difference in collet surface speeds breaks the strand 178 to complete the transfer of strand 178 to collet 152. In addition to differing the collet rotational speeds while turret 154 is rotating to the start position for collet 170, shield portion 242 is extended back between collets 152, 170 (FIG. 15E).

Referring now to FIGS. 16 and 17A–17C, the control system for the winder and the sequence of controlling the various components of the winder will be discussed.

Referring to FIG. 16, the control system comprises a programmable controller 1600, six motor controls 1602–1612, inductive pickups 1611 (on unit 168), 1613 (on oscillating unit 160), an inductive pickup 1614 (on frame 176; FIG. 3A), oil mist control valve 1616, a lubricating water control valve 1618, feedback switch 232, air valve 1620, water spray valve 1622, an air flow detector switch 1624, a strand transfer switch 1630, and a run switch 1632. The control system also includes a system power supply 1628 which selectively provides the system with electrical power in accordance with the status of a system ON/OFF switch 1626. By way of example only, the programmable controller can take the form of a Model 2800 programmable controller available from Control Technology Corp., Hopkinton, Mass.

In general, controller 1600 samples the statuses of system inputs which include inductive pickups 1611, 1613 and 1614, feedback switch 232, air flow detector switch 1624, strand transfer switch 1630 and run switch 1632. Based upon the inputs, controller 1600 communicates with motor controls 1602–1612 and sends control signals to valves 1616, 1618, 1620 and 1622; such that winder 150 performs a particular fiber winding process properly. More detailed descriptions of controller 1600's interaction with the above-listed winder 150 components is discussed below.

Motor controls 1602–1612 are coupled to programmable controller 1600 by a bi-directional data bus 1634. This arrangement is schematically represented in FIG. 16. Motor controls 1602–1612 provide data representative of the elapsed number of motor revolutions and direction to controller 1600. More specifically, each motor 156, 172, 174, 312, 314 and 400 includes an encoder which provides a separate pulse and 200 pulses per revolution of the motor. Motor controls 1602–1612 include memory for storing elapsed motor revolution data, accumulated pulse data and control data from controller 1600. The revolution and pulse data is in 8 bit format, and, when this memory is read by controller 1600, provides controller 1600 with the number of elapsed motor revolutions and pulse data. The pulse data provides controller 1600 with the information which is necessary to determine elapsed revolutions to an accuracy of 1/200th of a revolution. (Turret drive motor 156 rotates turret 154 via gears 182 and 184 which have a ratio of 30-to-1. Thus, the elapsed revolutions of turret 154 can be determined to an accuracy of 1/6000th of a revolution.)

Motor controls 1602–1612 are also configured to accept data from controller 1600. This data is stored in controller 1600 memory and serves to start and restart motor revolution counting, and controls the direction and rpm of a motor being controlled by a particular motor control 1602–1612. The control data provided to motor controls 1602–1612 by programmable controller 1600, is also 8-bit data.

The use of motor controls 1602–1612 in conjunction with controller 1600 allows bi-directional control of all motors 172, 174, 156, 310, 312 and 400. Accordingly, depending upon a particular fiber and its winding requirements, turret 154 and collets 152, 170 can be controlled with controller 1600 and motor controls 1602, 1610 and 1612 to rotate in both directions.

Programmable controller 1600 is also coupled to inductive pickups 1611, 1613 and 1614. Pickups 1611, 1613 and 1614 are sampled by programmable controller 1600 at a sampling rate high enough to ensure that controller 1600 will sample a pulse produced by inductive pickups 1611, 1613 and 1614 when oscillating units 160 and 168 or turret 154 reach their respective initialization positions. More particularly, inductive pickup 1611 produces a pulse when outboard spiral assembly 320 is fully retracted toward oscillating unit 168, pickup 1613 produces a pulse when portion 430 is fully retracted toward unit 160, and pickup 1614 produces a pulse when turret 154 is reaches a predetermined position during rotation.

Programmable controller 1600 is also coupled to feedback switch 232, air flow detector switch 1624, strand transfer switch 1630, and run switch 1632. Each of these switches is binary in nature. Switches 232 and 1624 are either open or closed, depending upon their state. More specifically, feedback switch 232 is open when winding shield 190 is in a first position, and closed when winding shield 190 is in a second position, while air flow detector switch 1624 is open when no air flow exists and closed when an air flow is present. Accordingly, programmable controller 1600 samples switches 232 and 1624 at a rate which will ensure that a status change in the switch is detected by programmable controller 1600.

Air flow detection switch 1624 monitors the flow of cooling air over fiber winder 150 from an external source (not shown). As discussed above, depending upon the environment within which winder 150 is situated, the requirement of a cooling air flow, and thus, switch 1624, for winder 150 may not be required.

Switches 1630 and 1632 are normally open switches. More specifically, switches 1630 and 1632 are only momentarily closed when depressed by an operator. Thus, programmable controller 1600 is required to sample these switches at a rate sufficiently high to detect a momentary depression by an operator.

Programmable controller 1600 controls oil mist control valve 1616, lubricating water control valve 1618, air valve 1620, and water spray valve 1622. Each of these valves is capable of assuming an ON or an OFF position, and is controlled by programmable controller 1600 via a control line 1636, by providing a selected valve with a binary signal which establishes the status of the particular valve, i.e., ON or OFF.

System ON/OFF switch 1626 controls the provision of power to programmable controller 1600. Each time switch 1626 is switched from OFF to ON, programmable controller 1600 and the operating sequence of winder 150 is initialized as will be discussed with reference to FIGS. 17A–17C.

Figure 17A:
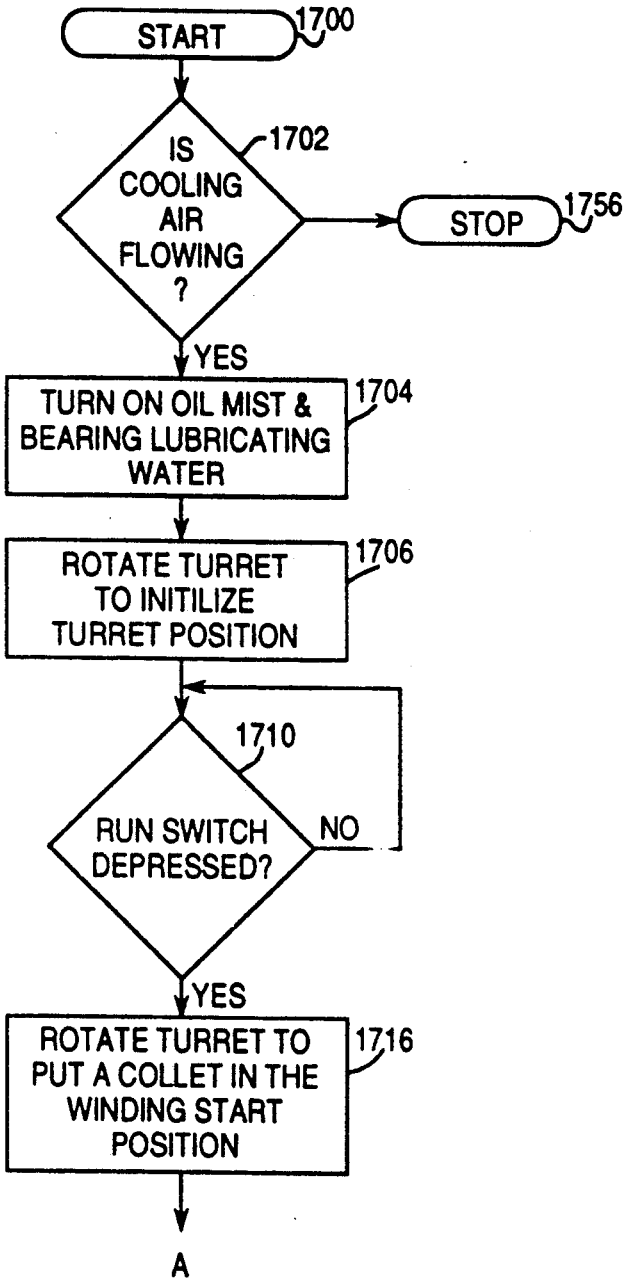
FIGS. 17A–17C is a flow chart for the control sequence of the winder.
Figure 17B:
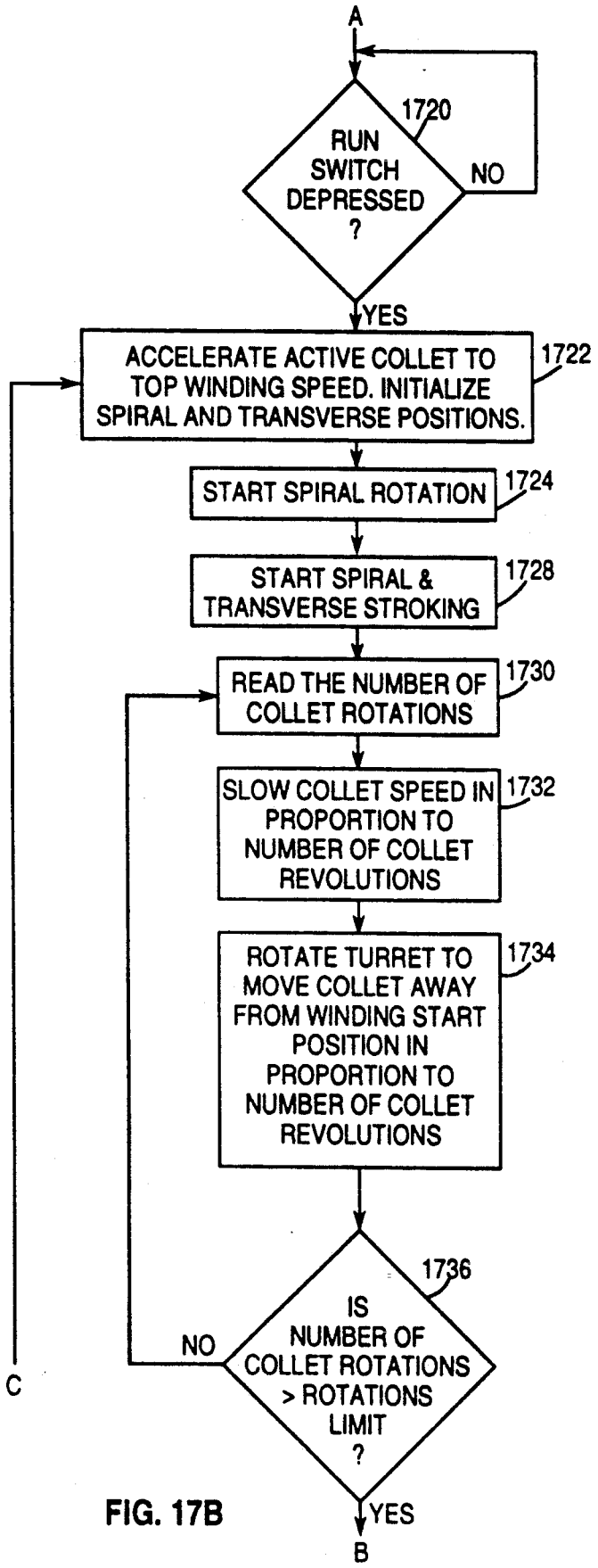
Figure 17C:
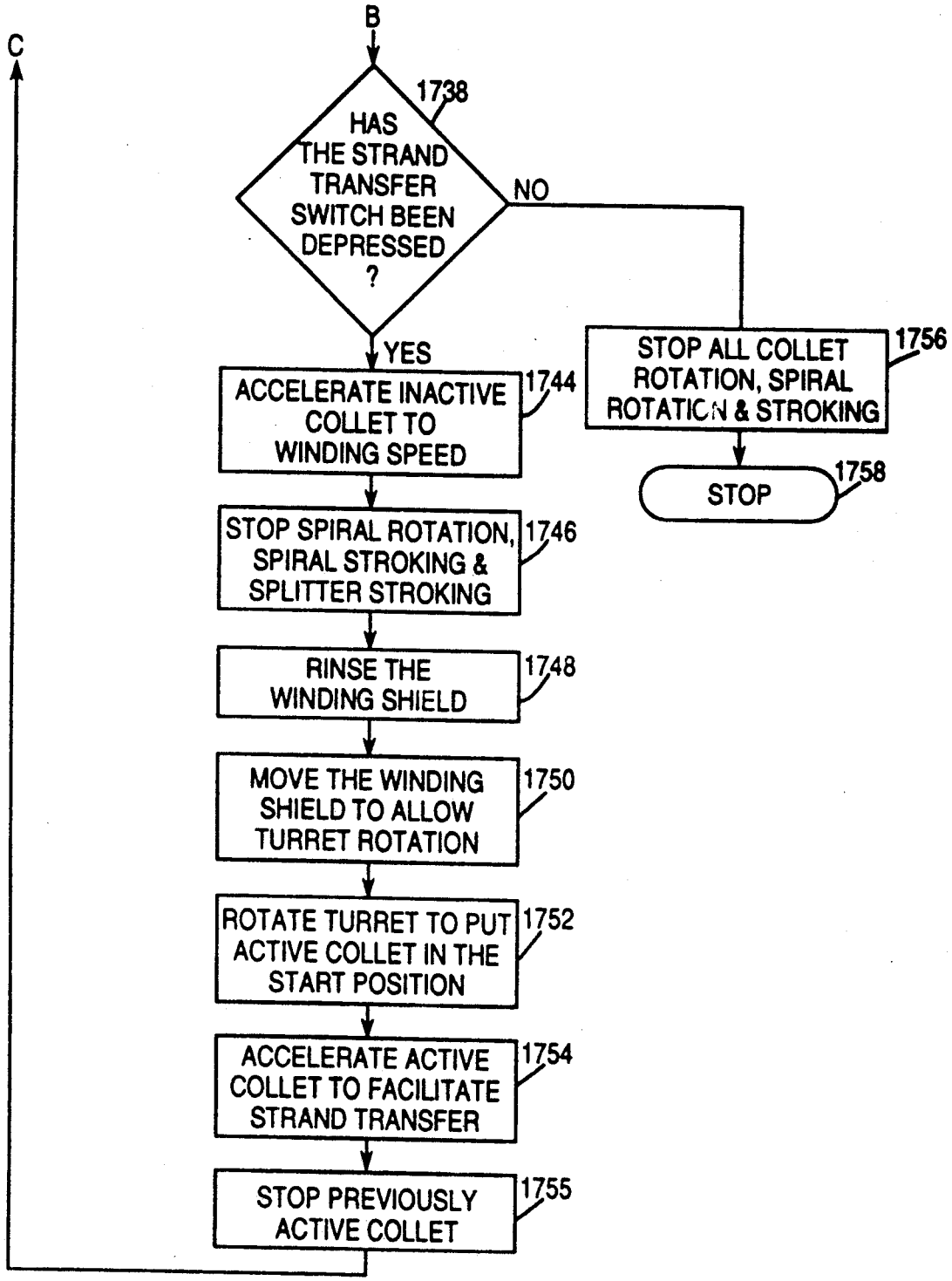

Referring now to FIGS. 17A–17C, programmable controller 1600, or another suitable control device, controls the winding process carried out by winder 150 as follows:

Upon application of power to the system (step 1700), programmable controller 1600 is initialized in a conventional manner. A sequence of system initialization steps are then executed. The status of an airflow detector switch 1124 is coupled to determine whether or not cooling air is flowing over winder 150 (step 1702). If no air flow is present, further application is terminated (step 1750). Assuming cooling air is flowing, the oil mist and bearing lubricating water are turned on (step 1704); control signals are generated to turn valves 1616 and 1618 ON. Turret 154 is then rotated to a predetermined initialization position (appropriate control signals are applied to turret motor control 1602 which in turn causes turret drive motor 156 to rotate until it reaches the initialization position) and the revolution count maintained in turret motor control 1602 is set to zero (step 1706). The initialization position is defined as the location where inductive pickup 1614 provides a signal to programmable controller 1600.

Initialization of turret 154 position provides a reference point from which controller 1600 rotates turret 154 to predetermined positions in response to the number of pulses provided by the encoder of turret drive motor 156. Subsequent to initialization, controller 1600 samples switch 1632 until switch 1632 is depressed by the operator to begin the winding process (step 1710). Upon depression of switch 1632, turret 154 is rotated to move collet 170 to its fiber winding start positions (step 1716). Referring to FIG. 3, a plurality of lines A1, A2, and A3 corresponding to the rotational position of collets 152 and 170 are illustrated. A1 is a substantially vertical reference axis. The relative angular rotation of turret 154 will be discussed in reference to line A1. When collet 170 is moved by turret 154 to its winding start position (step 1716), longitudinal axes A4 and A5 of collets 170 and 152 are disposed on line A3. At the winding start position for collets 170 and 152, the angular position of turret 154 is set such that the included angle between lines A3 and A1 is approximately 45°. In this position, fibers 178 to be wound upon collet 170 are engaged with collet 170 by the winder operator so that winding of the fibers 178 can be initialized upon collet 170.

To rotate turret 154 such that collets 152 and 170 can be moved to the winding start position, controller 1600 continuously reads the memory of motor control 1602 to determine elapsed motor revolutions and sends motor control signals to control 1602. Turret drive motor 156 selectively rotates turret 154 until the appropriate number of motor revolutions occur, thus, moving either collet 152 or collet 170 to its selected position. Turret drive motor 156 is able to provide full torque at zero (0) rpm. Thus, when winding is occurring and the tension in fibers 178 tends to rotate turret 154, turret drive motor 156 prevents turret 154 from rotating from its selected position. After rotation of turret 154 is completed, controller 1600 samples switch 1632 until switch 1632 is depressed.

Winding of fibers 178 on collet 170 is started when run switch 1632 is depressed by an operator (step 1720). Upon detecting the depression of run switch 1632 (step 1720), controller 1600 provides the appropriate control signals to motor control 1610 so that collet rotation motor 174 accelerates collet 170 to winding speed (between approximately 3,300 and 6,000 rpm depending upon the type of glass fiber being wound upon collet 170) and the appropriate control signals to controls 1604 and 1606 so that outboard spiral assembly 320 and mounting portion 430 of oscillating units 160 and 168 are placed in their respective initialization positions (step 1728). Controller 1600 provides the appropriate control signals to controls 1606 and 1608 until motors 312 and 400 have moved outboard spiral assembly 320 and portion 430 into their respective initialization positions, at which point pickups 1611 and 1613 provide pulses which are sampled by controller 1600.

Subsequent to the initialization of the outboard spiral assembly 320 and portion 430 positions, the stroking and rotating actions of outboard spiral assembly 320 and portion 430 are initiated by controller 1600. More specifically, controller 1600 sends the appropriate control signals to motor controls 1604, 1606 and 1608, which causes motor 310 to rotate spiral shaft 165 at a speed appropriate for the particular glass fiber being wound, motor 312 to oscillate outboard spiral assembly 320 and motor 400 to oscillate portion 430 and the attached strand splitter 158 (step 1724). These oscillating actions are controlled by controller 1600 with data provided to oscillator motor controls 1606 and 1608, which in turn control the speed and direction of servo motors 312 and 400. To provide the stroking action, servo motors 312 and 400 are alternately driven for a predefined number of revolutions, in forward and reverse. The speed at which servo motors 312 and 400 are driven is not required to be constant over the travel of the strokes and will depend upon the type of glass fiber being wound.

After starting the stroking (step 1728), controller 1600 reads the number of rotations made by collet 170 (step 1730); a running total of the number of pulses received via collet motor controls 1610 or 1612 indicative of total revolutions from the encoder of collet rotation motor 172. Controller 1600 performs this task by reading the memory of motor control 1612 associated with collet rotation motor 174 and collet 170. In particular, controller 1600 reads the portion of memory which stores elapsed motor revolutions and accumulated pulses.

Based upon the number of rotations of collet 170, the rotational speed of collet 170 is controlled to maintain the linear speed of fibers 178 substantially constant during winding (step 1732). The attenuation of fibers 178 is dependent upon the linear speed at which fibers 178 are exuded from the glass furnace (not shown). Additionally, if the attenuation of fibers 178 is not substantially constant, the diameter of fibers 178 will vary outside of an unacceptable range. Since the linear speed of fibers 178 is dependent upon the diameter of package 180 and the collet rotational speed, the rotational speed must be decreased as package 180 diameter increases to maintain a substantially constant fiber speed.

Package 180 diameter is substantially proportional to the number of rotations made by collet 170. Accordingly, controller 1600 decreases the rotational speed of collet rotation motor 174 based upon the elapsed number of collet rotations such that the speed of collet 170 is decreased at a rate which maintains the linear speed of fibers 178 substantially constant. In particular, controller 1600 can use an implementation of the following equations to decrease the rotational speed (RPM) of motor 174:

$$RPM = K*N;$$

where K is a constant of proportionality based upon strand 178 type. N (the number of collet 170 rotations) is read by controller 1600 (step 1730) from the memory of control 1612. Based upon the value calculated for RPM, controller 1606 sends the appropriate RPM control signal to control 1612.

Based upon the number of rotations of collet 170, the angular rotation of turret 154 is controlled to maintain a suitable angle between fibers 178 and the surfaces of cakes (packages) 180 (step 1734). Failure to maintain a suitable angle (winding angle) results in poor fiber quality and/or a package wherein subsequent removal of the fiber from the package is difficult. Since the winding angle is dependent upon package 180 diameter and the location of collet 170, turret 154 must be rotated to move collet 170 in such a way as to maintain a substantially constant winding angle even though package 180 diameter increases during winding.

Package 180 diameter is substantially proportional to the number of rotations made by collet 170. Accordingly, based upon the elapsed number of rotations of collet rotation motor 174, controller 1600 controls the rotation of turret 154 to position collet 170 such that the winding angle remains substantially constant. In particular, controller 1600 can use an implementation of the following equation to control the angular ($\theta_w$) rotation of turret 154 relative to line A1 (FIG. 3):

$$\theta_w = K_1*N$$

where $K_1$ is a constant of proportionality based upon strand 178 type. N is read by controller 1600 (step 1730) from the memory of control 1612. Based upon the value calculated for $\theta_w$ controller 1600 sends the appropriate control signals to control 1612 to rotate turret 154 to position collet 170 such that the winding angle is proper.

By way of example, referring to FIG. 3, to maintain a substantially constant winding angle, turret 154 is rotated such that axis A4 of collet 170 is moved from line A3 to line A2. Line A1 is substantially vertical, the included angle between line A2 and A1 is about 22½ degrees, and the included angle between line A1 and axis A4 is about 45 degrees.

In addition to controlling the collet 170 rotational speed and winding angle based upon the number of collet 170 rotations, the final diameter of packages 180 are based upon the number of collet rotations. Depending upon the type of fiber being wound, a rotation limit for the total number of collet rotations required to form a complete package 180 is determined. To control the final package 180 diameter, controller 1600 compares the number of elapsed collet rotations to the rotation limit (step 1736) every time the number of elapsed collet rotations is sampled (step 1730). If the rotation limit has not been exceeded, the number of elapsed collet rotations is sampled (step 1730) and steps 1732, 1734 and 1736 are carried out again as discussed above.

In the event that the rotation limit is exceeded, controller 1600 determines whether or not strand transfer switch 1630 has been depressed (step 38; FIG. 17C). Strand transfer switch 1630 is monitored to ensure that collet 152 is properly prepared for winding. For example, in the event that completed winding packages have not been removed from collet 152, winding should not automatically begin upon collet 152. This would destroy the existing packages upon collet 152.

Assuming that strand transfer switch 1630 has been depressed by an operator to initiate winding on collet 152, the formerly inactive collet 152 is accelerated to winding speed (step 1744). Controller 1600 causes the acceleration of the collet rotation motor 172 and collet 152 by providing the appropriate control signals to collet motor control 1610.

Spiral shaft 165 rotation, spiral shaft 165 stroking, and strand splitter 158 stroking are then stopped (step 1746); controller 1600 provides the appropriate control signals to spiral motor control 1604 and oscillator motor control 1606 and 1608. Subsequently, winding shield 190 is rinsed with jets of water from the water jets 216 (step 1748). Controller 1600 controls this rinsing process by providing an ON signal to water spray valve 1622 for a predetermined amount of time such that the appropriate amount of rinsing occurs and subsequently sends an OFF signal to valve 1622.

To rotate turret 154 such that collet 152 is positioned in the winding start position, winding shield 190 (or 238) must be operated such that winding shield 190 does not interfere with and break fibers 178 while turret 154 is being rotated (step 1750).

Controller 1600 controls the movement of the winding shield (190 or 238) by providing an ON signal to air valve 1620, which allows an air flow to pneumatic cylinder 222 appropriate to move winding shield 190.

After winding shield 190 is moved, turret 154 is rotated clockwise (FIG. 12B) to move collet 152 to the winding start position (axis A5 of collet 152 is disposed on the portion of line A3 to the right of line A1 as illustrated in FIG. 3). Controller 1600 causes the appropriate rotation of turret 154 by providing the appropriate control signals to turret motor control 1602 while monitoring the location of turret 154 by sampling accumulation of motor rotations stored in the memory of motor control 1602.

Collet 152 is then accelerated above the rotational speed of collet 170 such that the speed differential between collets 152 and 170 causes fibers 178 to wrap about collet 152 and break (step 1754). Fiber winding upon collet 170 then ceases and fiber winding upon collet 152 continues. Depending upon the type of strand 178 being wound, the turret 154 may be selectively rotated either clockwise or counter-clockwise from the winding start position to facilitate fiber transfer from collet 170 to collet 152.

The previously active collet 170 is then decelerated and stopped (step 1755). (For purposes of breaking fibers 178, collet 170 can be decelerated while collet 152 is accelerating.) Both steps 1754 and 1755 are performed by controller 1600 by providing the appropriate control signals to collet motor controls 1610 and 1612 to control the rotational speed of collets 152 and 170. After step 1755 is performed, steps 1722–1736 are repeated to carry out the glass winding process upon collet 152 in the manner in which it occurred upon collet 170.

Referring back to step 1738, when the strand transfer switch 1630 is not depressed, collets 152 and 170 are stopped, spiral rotation is stopped, and all stroking is stopped (step 1756). The system is then stopped (step 1758). The purpose of these steps is to avoid the situation where the winding of packages 180 continues indefinitely.

It will be understood that the foregoing description is of two preferred embodiments of the present invention and is not limited to the specific forms shown. For example, variations in fiber type and/or size may require a modification of the timing and sequence of actions re-executed by controller 1600. Modification may be made in the design and arrangement of the element within the scope of the present invention as expressed in the appended claims.

What is claimed is:

1. A fiber winding apparatus of the type comprising a support structure, a turret rotatably supported relative to the support structure, a first collet rotatably supported by the turret, and a second collet rotatably supported by the turret, improved wherein the apparatus further comprises a variable configuration winding shield for inhibiting the transfer of debris between the first collet and the second collet, the winding shield being selectively configurable into a fiber winding configuration and a fiber transfer configuration, wherein the turret and collets are each disposed about a respective longitudinal axis, the longitudinal axes being substantially parallel, the winding shield comprising:

a stationary shield portion having a nominal central axis disposed on the turret such that the central axis is substantially parallel with the longitudinal axis of the turret;

a movable shield portion; and means for selectively moving the movable shield portion into engagement with the stationary shield portion to establish the fiber winding configuration and out of engagement with the stationary shield portion to establish the fiber transfer configuration, wherein the turret is permitted to rotate without interference between the collets and the winding shield.

2. A fiber winding apparatus of the type comprising a support structure, a turret rotatably supported relative to the support structure, a first collet rotatably supported by the turret, and a second collet rotatably supported by the turret, improved wherein the apparatus further comprises a variable configuration winding shield for inhibiting the transfer of debris between the first collet and the second collet, the winding shield being selectively configurable into a fiber winding configuration and a fiber transfer configuration, wherein the winding shield comprises:

a stationary shield unit;

a translating shield member slidably supported by the stationary shield unit such that the translating shield member is extended outward from the shield unit to establish the fiber winding configuration and retracted into the shield unit to establish the fiber transfer configuration;

means for fixing the shield unit to the turret such that the translating shield member is interposed between the first collet and the second collet when extended outward from the shield unit; and means for extending and retracting the translating shield member from the shield unit.

3. A fiber winding apparatus comprising:

a support structure;

a turret supported relative to the support structure such that the turret is permitted to rotate;

first and second collets rotatably supported by the turret;

means for selectively rotating the turret clockwise and counter-clockwise between a first predetermined position and a second predetermined position;

means for selectively preventing the turret from rotating while in the first and second predetermined positions; and a variable configuration winding shield which inhibits the transfer of debris between the first collet and the second collet, the winding shield having a stationary portion and a rotatable portion, and means for moving the rotatable portion into and out of engagement with the stationary portion to establish a fiber winding configuration and a fiber transfer configuration.

4. The apparatus of claim 3, wherein the means for selectively preventing comprises a turret rotation motor.

5. A fiber winding apparatus comprising:

a support structure;

a turret supported relative to the support structure such that the turret is permitted to rotate;

first and second collets rotatably supported by the turret;

means for selectively rotating the turret clockwise and counter-clockwise between a first predetermined position and a second predetermined position;

means for selectively preventing the turret from rotating while in the first and second predetermined positions; and a variable configuration winding shield which inhibits the transfer of debris between the first collet and the second collet, the winding shield being selectively configurable into a fiber winding configuration and a fiber transfer configuration, wherein the turret and collets rotate about respective longitudinal axes, the longitudinal axes being substantially parallel, the winding shield comprising:

a stationary shield portion having a nominal central axis disposed on the turret such that the central axis is substantially parallel with the longitudinal axis of the turret;

a movable shield portion; and means for moving the movable shield portion into engagement with the stationary shield portion to establish the fiber winding configuration and being movable out of engagement with the stationary shield portion to establish the fiber transfer configuration, wherein the turret is permitted to rotate without interference between the collets and the winding shield when the winding shield is in the fiber transfer configuration.

6. A fiber winding apparatus comprising:

a support structure;

a turret supported relative to the support structure such that the turret is permitted to rotate;

first and second collets rotatably supported by the turret;

means for selectively rotating the turret clockwise and counter-clockwise between a first predetermined position and a second predetermined position;

means for selectively preventing the turret from rotating while in the first and second predetermined positions; and a variable configuration winding shield which inhibits the transfer of debris between the first collet and the second collet, the winding shield being selectively configurable into a fiber winding configuration and a fiber transfer configuration, wherein the winding shield comprises:

a stationary shield unit;

a translating shield member slidably supported by the stationary shield unit such that the translating shield member is extended outward from the shield unit to establish the fiber winding configuration and retracted into the shield unit to establish the fiber transfer configuration;

means for fixing the shield unit to the turret such that the translating shield member is interposed between the first collet and the second collet when extended outward from the shield unit; and means for extending and retracting the translating shield member from the shield unit.

* * * * *